US007971597B2

(12) United States Patent
Reyen et al.

(10) Patent No.: US 7,971,597 B2
(45) Date of Patent: Jul. 5, 2011

(54) WIRE TRAY AND TENT FRAME INCORPORATING SAME

(75) Inventors: James G. Reyen, Binghamton, NY (US); Matthew H. Hamilton-Jones, Endicott, NY (US); Joseph G. Wiegand, Conklin, NY (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 12/405,346

(22) Filed: Mar. 17, 2009

(65) Prior Publication Data

US 2009/0230257 A1 Sep. 17, 2009

Related U.S. Application Data

(60) Provisional application No. 61/037,200, filed on Mar. 17, 2008.

(51) Int. Cl.
*E04H 15/32* (2006.01)
*E04B 9/04* (2006.01)

(52) U.S. Cl. ..... 135/122; 135/91; 135/119; 52/63; 52/222; 52/506.07

(58) Field of Classification Search ..... 135/121–124, 135/147, 115, 119, 161, 908, 91, 158; 52/220.1, 52/220.6, 63, 222, 506.6–506.7, 664–669, 52/718.04

See application file for complete search history.

(56) References Cited

U.S. PATENT DOCUMENTS

| | | | | | |
|---|---|---|---|---|---|
| 3,685,235 | A * | 8/1972 | Lang | 52/39 |
| 4,655,010 | A * | 4/1987 | Arquati | 52/63 |
| 4,766,951 | A * | 8/1988 | Bergh | 165/56 |
| 4,794,745 | A * | 1/1989 | Platt et al. | 52/506.07 |
| 4,841,688 | A * | 6/1989 | Rinaldi | 52/63 |
| 4,878,322 | A * | 11/1989 | Ikeda et al. | 52/2.18 |
| 4,885,877 | A * | 12/1989 | Hunt et al. | 52/63 |
| 5,134,250 | A * | 7/1992 | Caveney et al. | 174/101 |
| 5,265,393 | A * | 11/1993 | Bischel et al. | 52/461 |
| 5,687,527 | A * | 11/1997 | Bikard et al. | 52/506.08 |
| 6,338,226 | B1 * | 1/2002 | Gauthier et al. | 52/63 |
| 6,938,337 | B2 * | 9/2005 | Ewer et al. | 29/868 |
| 7,389,785 | B2 * | 6/2008 | Loudermilk et al. | 135/121 |

* cited by examiner

*Primary Examiner* — Winnie Yip
(74) *Attorney, Agent, or Firm* — Reinhart Boerner Van Deuren P.C.

(57) ABSTRACT

A wire tray and tent frame structural members are provided. The structural members include a utility channel or C-shaped channels to which wire trays can be mounted. More particularly, mounting structures of the wire tray insert into or otherwise engage the utility channel or engage the C-shaped channels and secure the wire tray to the structural members. The utility channel or C-shaped channels can include at least one undercut to prevent removal or disengagement of the mounting structure of the wire tray from the structural member. Similarly, methods of using the wire tray including resiliently biasing mounting structure of the wire tray to attach it to the structural member are provided.

26 Claims, 19 Drawing Sheets

WIRE TRAY AND TENT FRAME INCORPORATING SAME

CROSS-REFERENCE TO RELATED PATENT APPLICATIONS

This patent application claims the benefit of U.S. Provisional Patent Application No. 61/037,200, filed Mar. 17, 2008, the entire teachings and disclosure of which are incorporated herein by reference thereto.

FIELD OF THE INVENTION

This invention generally relates to tents and more particularly to tents, tent frames and devices for organizing wires for use with accessories hung from tent frames.

BACKGROUND OF THE INVENTION

A tent can be used for providing a shelter and environment for large gatherings and celebrations such as theatrical events, wedding receptions and conventions. A shell of the tent provides shelter and defines the environment for the event. The shell is typically formed from one or more fabric panels that are supported by a frame. The frame of a large tent typically includes a plurality of interconnected structural members that combine to support the shell. The structural members may include vertical legs that define the walls and rafters that extend at an angle relative to the vertical legs and toward a peak of the tent to define the roof.

As the tents are used to provide shelter for all types of events, the tents are typically adorned with accessories such as lighting, sound systems, decorations, fans, banners and heaters, to name a few. However, assembly of the tent and hanging of these accessories has been time consuming and even frustrating.

Normally, as the structural members of the tent frame are continuous beams, wires for connecting to electronic accessories such as, by way of non-limiting example, lighting, sound systems, fans and heaters drape between adjacent structural members. For example a cord running to a heater may drape between adjacent purlins which is aesthetically displeasing. To prevent the cords or wires from draping, the wires and cords may be tied to and run along rafters. However, this still aesthetically displeasing because another cord, bungee strap or other device is then required to secure the middle section of the wire to the rafter. Further, in many tents, the rafters are directly secured to the fabric panels forming the shell such that nothing can be wrapped around the rafter to support the free hanging portion of the wire.

Finally, weaving wires between the purlins and the fabric panels can be extremely time consuming and can occur at extremely elevated locations.

The present invention provides improved devices for housing wires used to power or send information to and from accessories that are hung within a tent.

BRIEF SUMMARY OF THE INVENTION

The present invention has several aspects that may be claimed and stand as patentable independently and individually or in combination with other aspects, including but not limited to the following.

In one embodiment, the invention provides a wire tray attachable to a structural member of a tent for storing and supporting wires or other devices that are to be hung from the structural member of the tent. In practicing an embodiment, a wire tray may include wire storing channels for securely storing wires. The wire tray prevents the need to wrap wires around the structural members of a tent and prevents the wires from draping between adjacent structural members.

In one particular implementation, the wire tray includes an abutment flange that rests against a structural member and a wire support flange that provides the support for the wires. The wire support flange includes upturned edges to form a channel in which the wires reside. The use of the upturned ends further enhances the aesthetic appeal of the wire tray by substantially completely hiding the wires from visibility. In a preferred implementation of the upturned edges, a distal portion of each of upturned ends is canted inwards so as to provide an undercut arrangement to assist in securing the wires in the wire tray.

The wire tray may be mounted to structural members by bolts, snap connections or other mounting devices. These devices may be formed as one piece in a single continuous body (i.e. not a plurality of bodies connected together) with the rest of the structures of the wire tray.

In one more particular implementation of an embodiment of the invention, a wire tray for mounting to a tent frame structural member comprising an elongated tray portion, first and second resilient mounting walls and first and second mounting clips is provided. The first resilient mounting wall extends outward from the elongated tray portion. The second resilient mounting wall is spaced apart from the first resilient mounting wall and extends outward from the elongated tray. The first mounting clip has a first clip portion extending laterally from the first resilient mounting wall. The second mounting clip has a second clip portion extending laterally from the first resilient mounting wall. The second mounting clip portion extends laterally opposite the first clip portion. By extending laterally from the mounting walls, the clip portions define catches that can engage cooperating catches of a corresponding tent structural member to create an interference engagement arrangement.

In one more particular implementation of the wire tray, the first and second clip portions extend away from one another and the first clip portion extends away from the second resilient mounting wall and the second clip portion extends away from the first resilient mounting wall. This arrangement is used to mount the wire tray to a structural member having a utility channel defining undercuts that face one another.

In an even more particular implementation of a wire tray, the first mounting clip includes a third clip portion extending laterally from the first resilient mounting wall. The third clip portion extends generally opposite to the first clip portion such that the first and third clip portions extend beyond opposite sides of the first resilient mounting wall. The second mounting clip includes a fourth clip portion extending laterally from the second resilient mounting wall. The fourth clip portion extends generally opposite to the second clip portion such that the second and fourth clip portions extend beyond opposite sides of the second resilient mounting wall. This double clip portion mounting clip arrangement provides for the ability to connect the wire tray to different attachment structure of the tent structural members. More particularly, this wire tray can also be attached to undercut walls that have the undercuts facing away from one another, in addition to undercut walls that have undercuts facing one another (i.e. such as undercuts defining a mouth through which the mounting walls extend).

The first and second mounting clips may have cam surfaces that provide a tapered surface that assist in resiliently flexing the mounting walls during attachment of the wire tray to a structural member. These cam surfaces may assist in flexing the mounting walls towards or away from one another. Thus, in some embodiments, the cam surfaces may face one another or face away from one another, depending on the direction they are intended on being used to bias the mounting walls.

In a further embodiment of the invention, a tent frame assembly including a structural member and a wire tray is provided. The structural member has an elongated body defining at least one attachment structure extending along a length of the structural member. The wire tray includes a mounting structure cooperating with the attachment structure to secure the wire tray to the elongated body, the wire tray further including a wire retaining channel formed between an elongated tray of the wire tray and the elongated body of the structural member.

In one implementation, the structural member includes a utility channel formed in a side thereof and extending along the length of the structural member. The utility channel defines a mouth portion and an enlarged mounting portion having a width that is wider than the mouth portion such that the utility channel defines a pair of undercuts on opposite sides of the mouth. The utility channel being the attachment structure, at least in part. The mounting structure of the wire tray include first and second resilient mounting walls and first and second mounting clips. The first resilient mounting wall extends outward from the elongated tray portion. The second resilient mounting wall is spaced apart from the first resilient mounting wall and extends outward from the elongated tray. The first mounting clip has a first clip portion extending laterally from the first resilient mounting wall. The second mounting clip has a second clip portion extending laterally from the first resilient mounting wall. The second mounting clip portion extends opposite the first clip portion. The first and second mounting clips engage the first and second undercuts with the first and second resilient mounting walls extending through the mouth portion.

In a preferred implementation, the first and second resilient mounting walls are connected to the elongated tray such that the connection points therebetween are spaced a first distance that is greater than a width of the mouth portion such that the first and second resilient mounting walls are biased toward one another by the mouth portion.

In a further implementation, the elongated body of the structural member includes a first side portion that has opposed ends that face generally away from one another and form the attachment structure. The opposed ends each have a first surface that faces generally outward and away from the rest of the structural member. The ends each include a second surface that is opposite the first surface and generally faces toward the rest of the structural member and away from the first surface. The mounting structure of the wire tray include first and second resilient mounting walls and first and second mounting clips. The first resilient mounting wall extends outward from the elongated tray portion. The second resilient mounting wall is spaced apart from the first resilient mounting wall and extends outward from the elongated tray. The first mounting clip has a first clip portion extending laterally from the first resilient mounting wall. The second mounting clip has a second clip portion extending laterally from the first resilient mounting wall. The second mounting clip portion extends opposite the first clip portion. The first mounting clip directly engages one of the opposed ends and the second clip directly engages the other one of the opposed ends such that the first side portion is positioned between the first and second resilient mounting walls.

In a preferred implementation, the first and second resilient mounting walls are connected to the elongated tray such that the connection points therebetween are spaced a first distance that is less than a second distance between the opposed ends of the first side portion such that the first and second resilient mounting walls are biased away from one another by the first side portion and into engagement therewith.

In a further embodiment of the invention, a method of connecting a wire tray to a structural member of a tent including first and second of attachment walls defining first and second undercuts is provided and includes the following steps: 1) resiliently biasing a first and a second resilient mounting wall of the wire tray to space a first mounting clip of the first mounting wall relative to a second mounting clip of the second mounting wall such that the first and second mounting clips may pass by first and second ends of the first and second attachment walls; 2) moving the wire tray and structural member toward one another such that the first and second mounting clips pass by the first and second attachment walls; and 3) releasing the first and second resilient mounting walls such that the first mounting clip extends into the first undercut and engages the first attachment wall and the second mounting clip extends into the second undercut engages the second attachment wall. Depending on the arrangement of the attachments structure of the structural member, the mounting walls may be resiliently biased toward or away from one another.

Additionally, in one implementation of the method, each mounting clip includes a tapered cam surface canted relative to the direction the wire tray and structural members are moved toward one another. The step of resiliently biasing a pair of resilient mounting walls is performed, at least in part, during the step of moving the wire tray and structural member toward one another. This step includes pressing one cam surface into one of the attachment walls and pressing the other one of the cam surfaces into the other one of the attachment walls such that the cam surfaces assist in resiliently biasing the pair of resilient mounting walls as the wire tray and structural members are moved toward one another.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
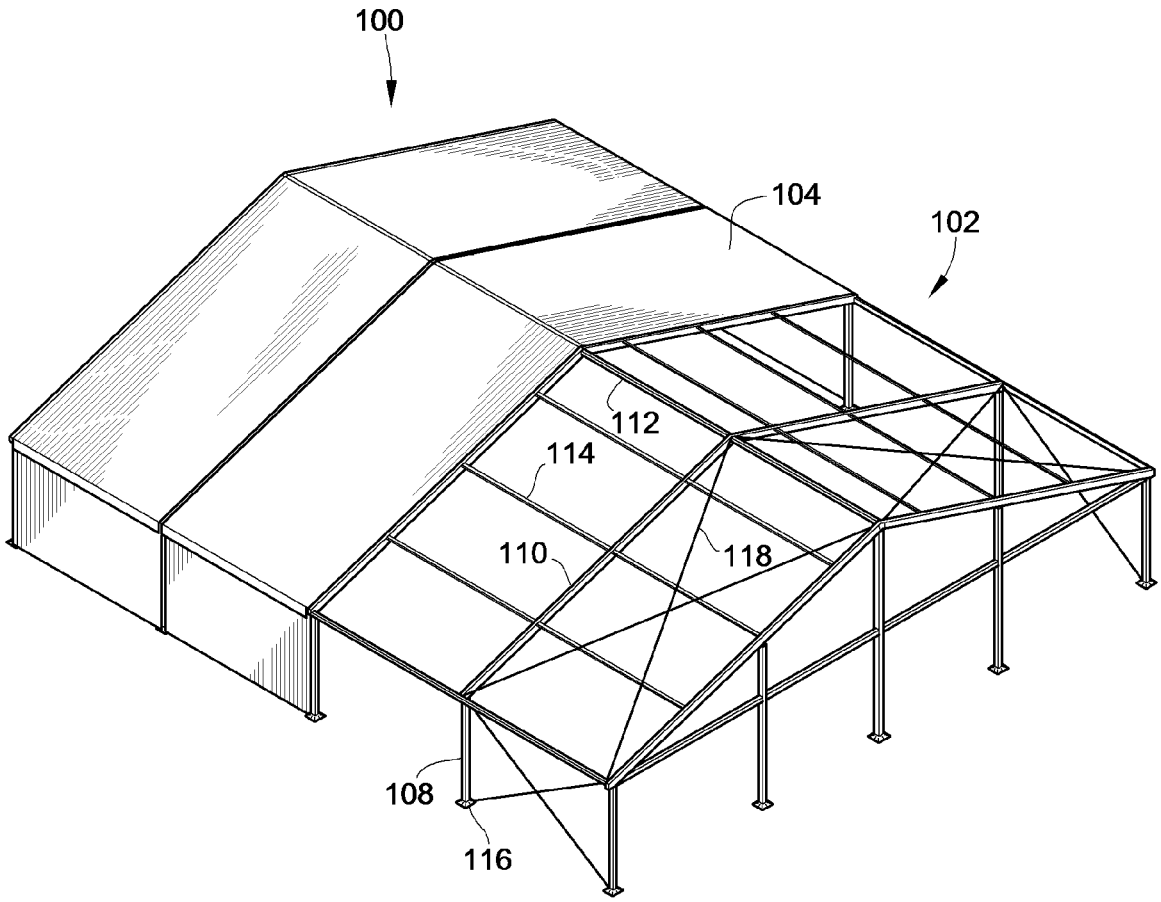
FIG. 1 is a partial perspective illustration of a tent according to the teachings of the present invention.

FIG. 1 illustrates a partial illustration of a tent 100 including structural members in accordance with the teachings of the present invention. The tent 100 includes a tent frame 102 that supports a shell 104 to provide a shelter or building like structure.

The tent frame 102 is generally constructed of a plurality of structural members including a plurality of legs 108 that generally define the vertical walls of the tent, a plurality of rafters 110 that extend at an angle relative to the legs 108 and that meet at the peak 112 of the tent 100 and a plurality of purlins 114 that extend horizontally between the rafters 110 and generally parallel to the peak 112. Typically, purlins 114 are made of smaller profiles. The peak 112 is formed by purlins 114. Purlins in this position are also referred to as ridge purlins. The illustrated tent frame 102, is a clear span tent frame that is free of interior poles.

The legs 108 are mounted to feet 116 which rest on the ground upon which the tent 100 is built. The feet 116 support the legs 108 in an upright or vertical orientation. During installation, the feet 116 allow the legs 108 to be pivoted from a horizontal position into an upright position.

The tent 100 may further include guy-wires 118 at predetermined locations that extend between various structural members to provide increased support and stability of the structure.

Figure 2:
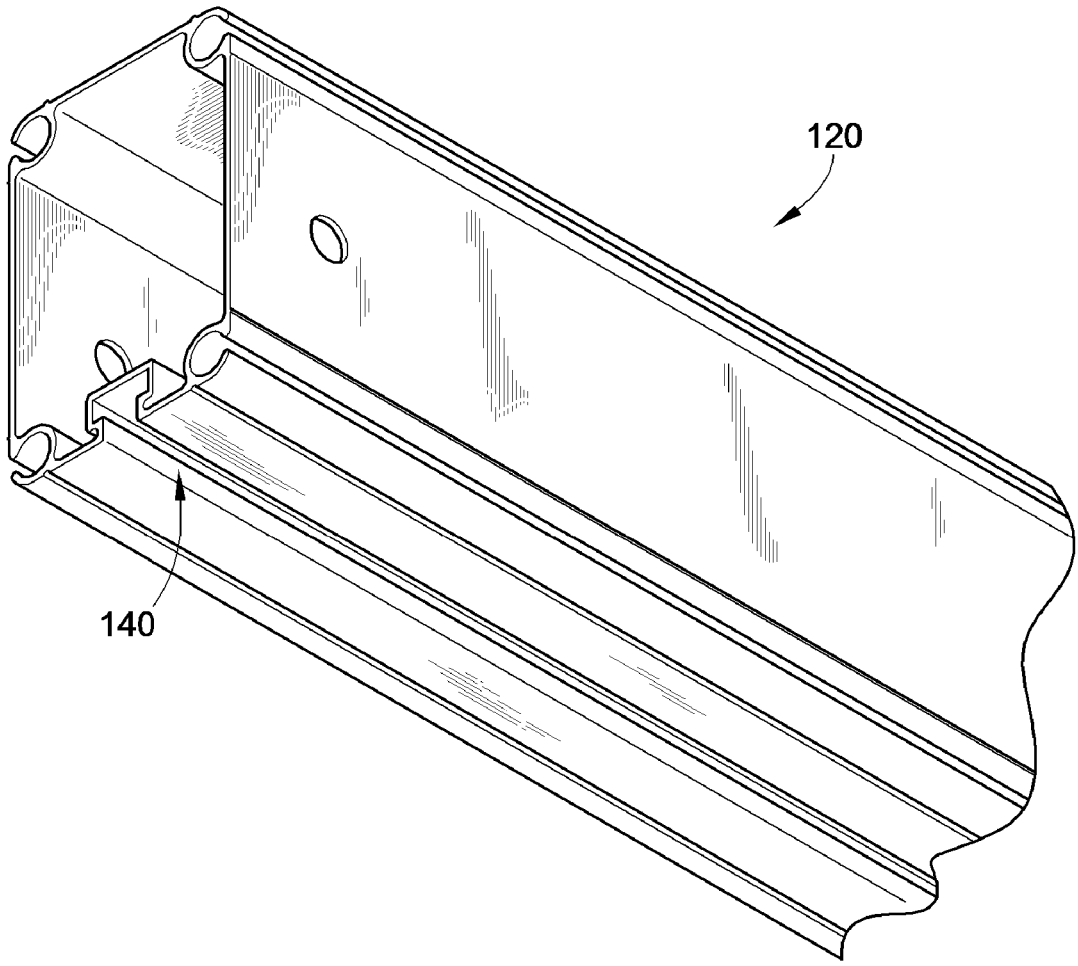
FIG. 2 is a perspective illustration of a structural member of the tent of FIG. 1.
Figure 3:
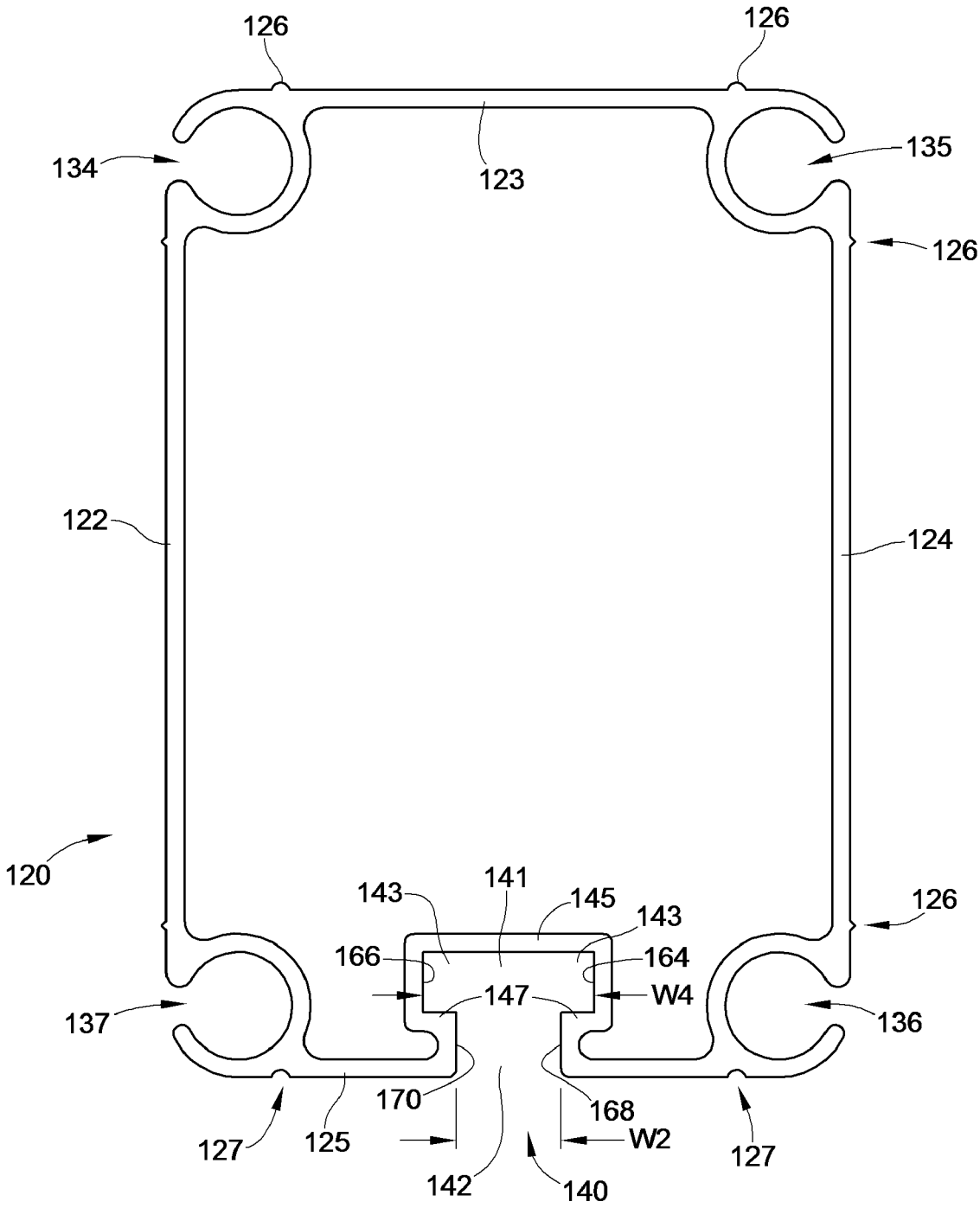
FIG. 3 is an end view of the structural member of FIG. 2.

FIGS. 2 and 3 illustrate a structural member 120 that can be used as any of the components of the tent frame 102, such as a leg 108, rafter 110 or purlin 114 of the tent frame 102. With primary reference to FIG. 3, the structural member 120 is of a hollow box beam construction having a generally rectangular cross-section including sides 122-125. Typically, the structural member 120 is formed from extruded metal, and more typically from extruded aluminum.

The corners formed by the intersections of adjacent ones of the sides 122-125 include C-shaped channels 134-137 that extend the length of the structural member 120. Channels 134-137 engage edges of fabric panels forming shell 104. The edges of the fabric panels generally include an enlarged region that is slid axially through channels 134-137 and laterally secures the fabric panels to the structural members 120.

Sides 122, 123, 124 include pairs of ribs 126 and side 125 includes channels 127. The ribs 126 of side 123 are sized and configured to cooperate with channels 127 of side 125 to align structural members 120 when they are stacked on top of each other for shipping or storage. This interlocks the structural members 120 to prevent tipping and promote integrity of a stack of structural members 120. Further, the ribs 126 assist in reducing the amount of surface area by which the structural members 120 are supported while surface treating the structural members 120, such as during anodizing.

Side 125 forms a utility channel 140 running the length of the structural member 120 The utility channel 140 of the illustrated embodiment has a T-shape including a generally rectangular retaining portion 141 connected to a smaller mouth portion 142. The mouth portion 142 provides access to the larger retaining portion 141. The mouth portion 142 has a smaller width than the retaining portion 141 such that the retaining portion 141 includes undercut regions 143, formed between wall portion 145 and bottom wall portions 147.

The utility channel 140 can be used to mount devices such as a clamp 146 (see FIG. 7), carabineer 148 (see FIG. 8), wire tray 150 (see FIG. 9) or other devices to the structural member 120.

Figure 4:
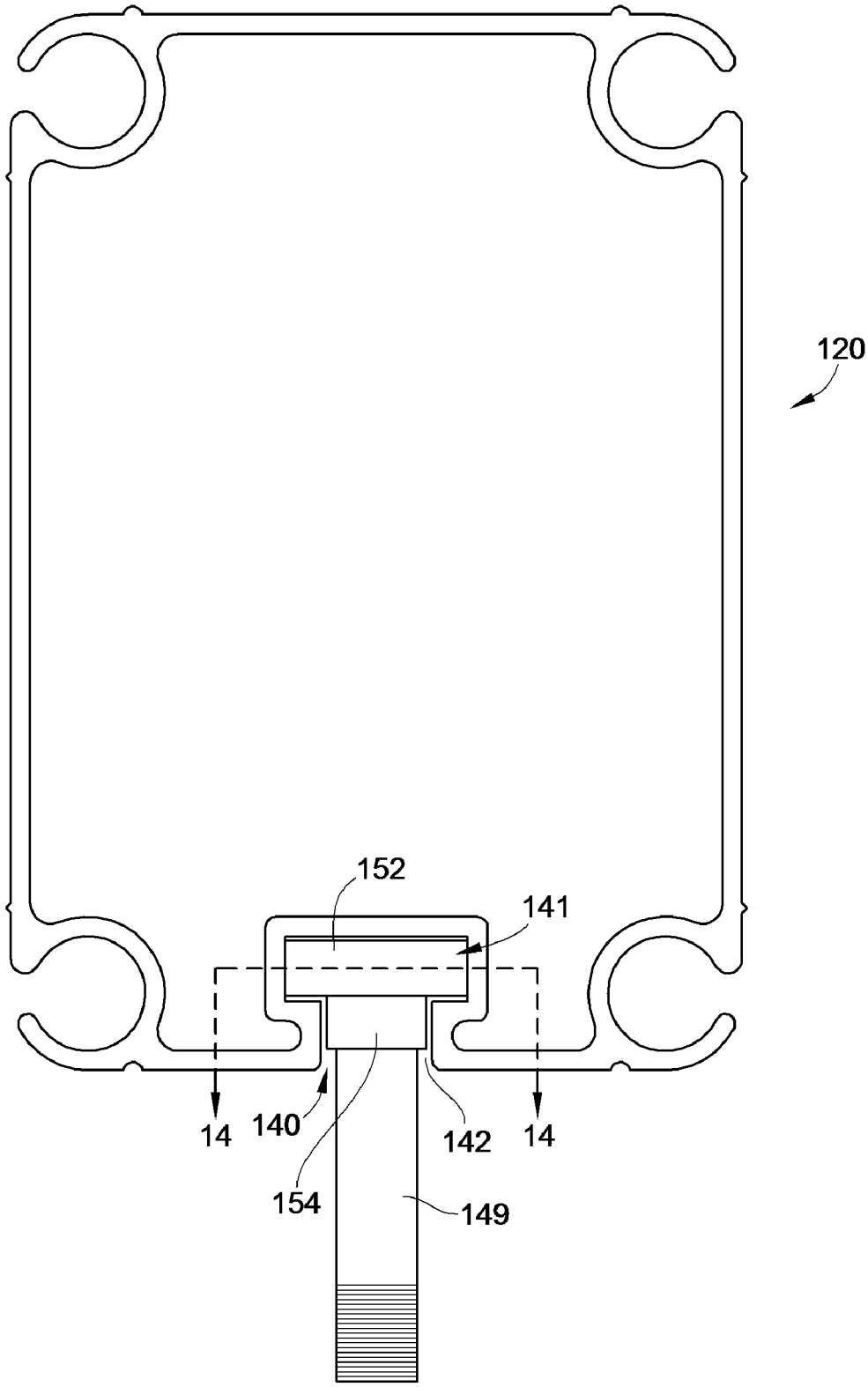
FIG. 4 is an end view of the structural member of FIG. 3 including an attachment member mounted to the structural member.
Figure 5:
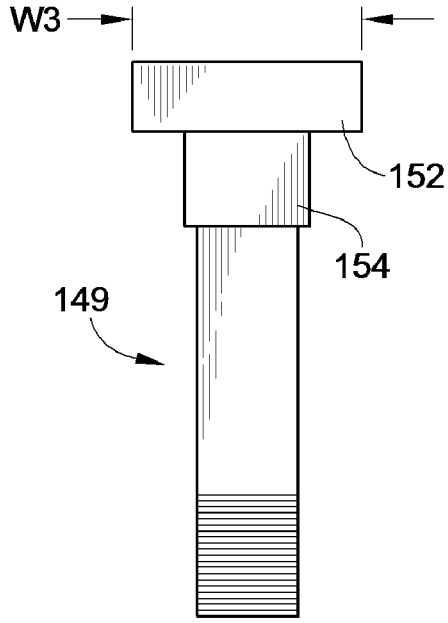
FIGS. 5 and 6 are front and side views of the attachment member of FIG. 4.
Figure 6:
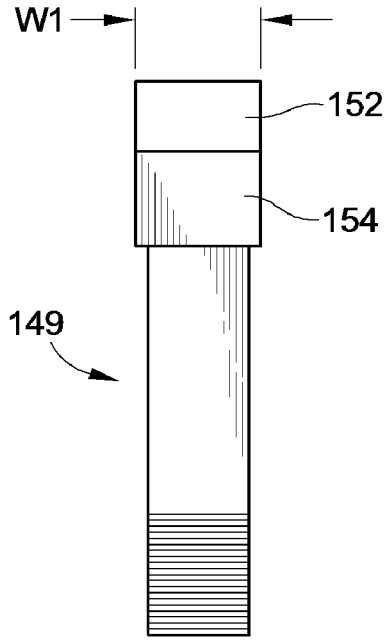

More particularly, the devices can be mounted to the structural member 120 using a mounting structure, such as a T-bolt 149 illustrated in FIGS. 4-6. The T-bolt 149 includes a mounting head 152 and neck portion 154 that corresponds to the T-shape of the utility channel 140. The neck portion 154 extends through mouth portion 142 of the utility channel 140 and connects the mounting head 152 to the device, such as the clip portion 156 of the carabineer 148 of FIG. 8.

The mounting head 152 is sized to be received and retained in the retaining portion 141 of the utility channel 140. More particularly, the mounting head 152 is sized and configured such that it can be arranged in the retaining portion 141 so that the mounting head 52 cannot pass through the mouth portion 142 of the utility channel 140.

In the illustrated embodiment, the mounting head 152 has a first dimension having a width W1 (see FIGS. 6 and 12) that is sized smaller than the width W2 (see FIG. 3) of the mouth portion 142 of the utility channel 140 such that the mounting head 152 can be inserted through the mouth portion 142 and into retaining portion 141. Further, the mounting head 152 has a second dimension having width W3 (see FIGS. 5 and 12), generally transverse to the first dimension, that is greater than the width W2 of the mouth portion 142.

As such, the mounting head 152 may be passed through the mouth portion 142 with the first dimension having width W1 aligned with the width of the mouth portion 142. Once the mounting head 152 has been received in the retaining portion 141, the T-bolt 149 can be rotated 90 degrees such that the larger dimension having width W3 is transverse to the width W2 of the mouth portion 142, preventing the mounting head 152 from passing back through the mouth portion 142. This embodiment presumed that width W3 is less than or substantially equal to the width W4 of the retaining portion 141 (see FIG. 3).

Figure 14:
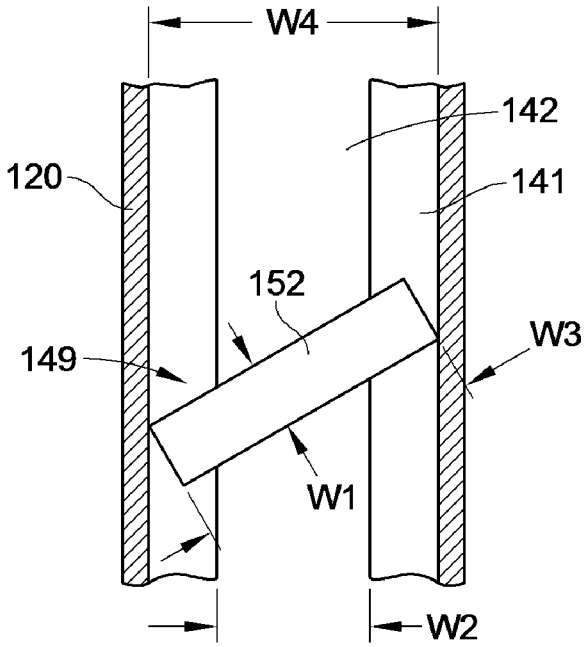
FIG. 14 illustrates a partial cross-section of a structural member taken about line 14-14 of FIG. 4, detailing one embodiment of an attachment structure inserted into a utility channel.

However, in alternative embodiments, the larger dimension having width W3 of the mounting head 152 could be larger than width W4 of the retaining portion 141, such as illustrated in FIG. 14 This can be beneficial such that as the T-bolt 149 is rotated relative to the structural member 120, the T-bolt 149 is prevented from rotating due to interference between the walls defining the retaining portion and the mounting head 152. Further, the mounting head 152 of the T-bolt 149 may be trapezoidal in shape such that the mounting head will lock into position when turned after insertion through mount portion 142. This locking prevents the T-bolt 149 from spinning indefinitely or, at least 180 degrees, such that it will re-align with the mouth portion 142 such that it can be removed.

Figure 12:
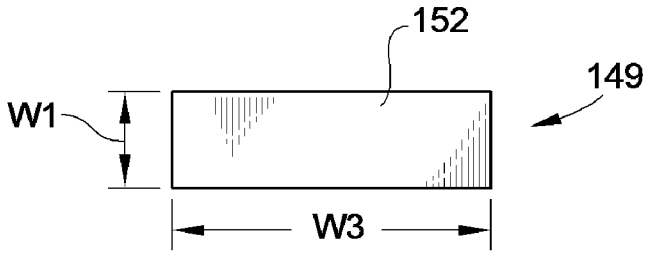
FIGS. 12 and 13 are top view illustrations of alternative mounting head arrangements of mounting structures according to the teachings of the present invention.
Figure 13:
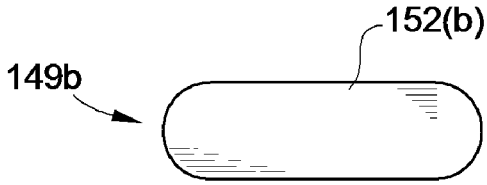

FIGS. 12 and 13 are top view illustrations of examples of mounting heads 152, 152B of T-bolts 149 and 149B according to the teachings of the present invention. Mounting head 152 has a rectangular cross-section while mounting head 152B has an oval or elliptical cross-section. However, alternative head shapes can be incorporated while staying within the scope of the invention.

Figure 7:
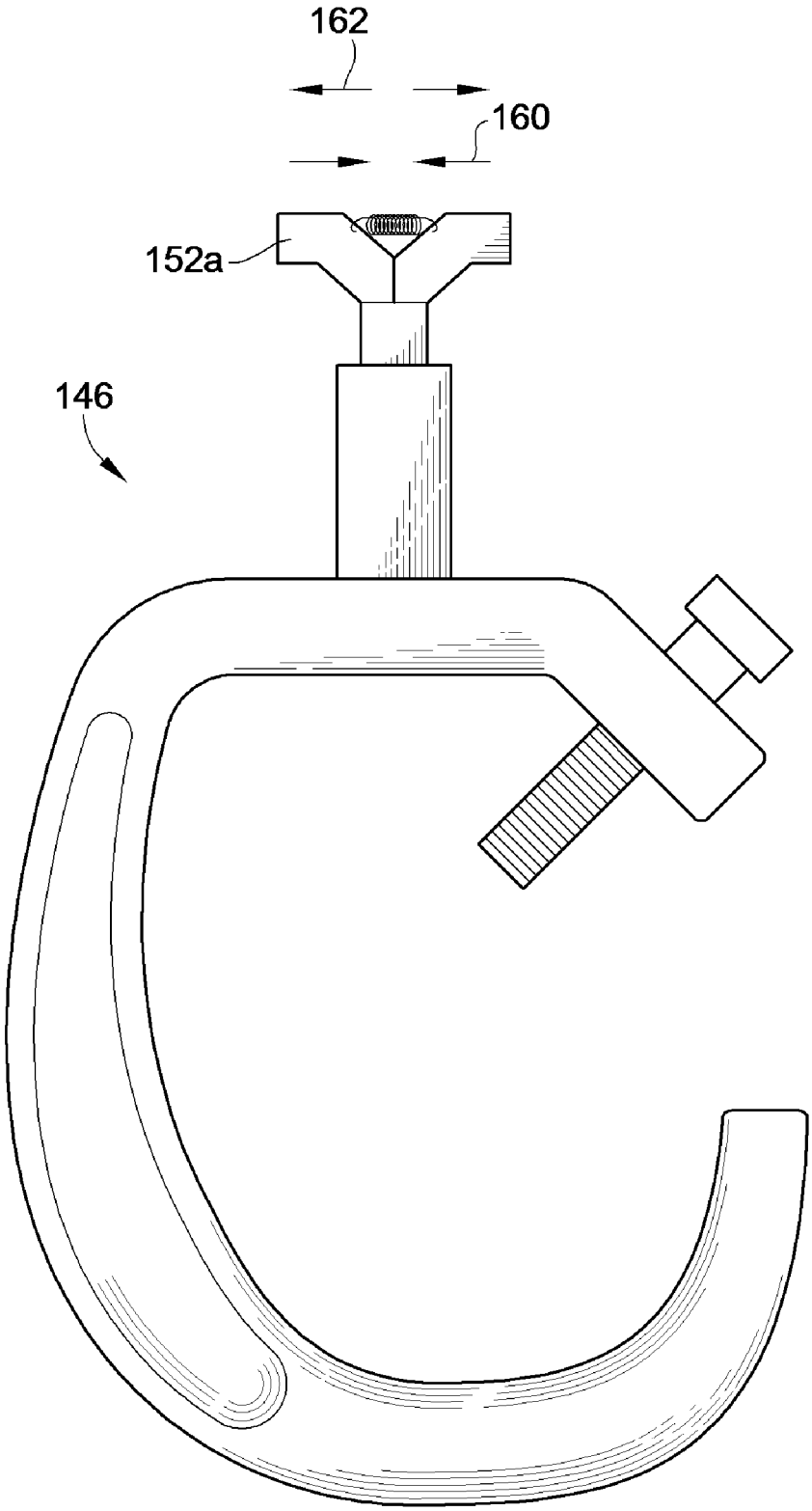
FIGS. 7-9 illustrate devices that can be attached to a structural member of FIG. 2.
Figure 8:
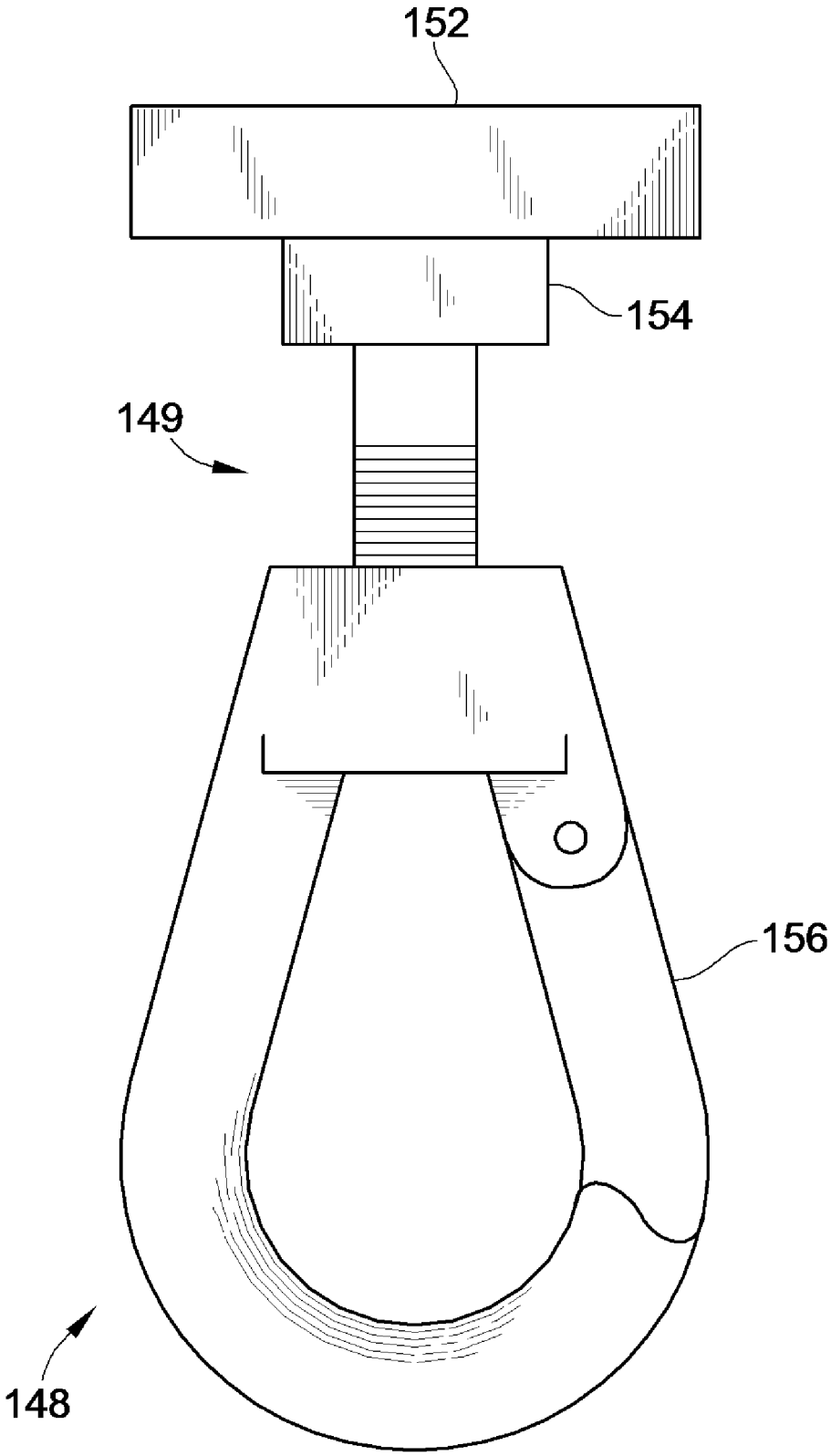

Alternatively, and with reference to FIG. 7, a mounting head 152*a* could include snap structure such that can be compressed (illustrated by arrows 160) such that it can be passed through the mouth portion 142 and that then expanded (illustrated by arrows 162) within the retaining portion 141 to retain the device to the structural member 120. The snap structure may sufficiently engage the walls defining the utility channel 140 to prevent rotation.

Further, devices may be mounted to the utility channels by using other types of mounting structure that are inserted through an end of the utility channel, rather than the mouth portion 142. Mounting structure such as bolts that have flats on their heads, for example as hex head bolt, can be inserted into the retaining portion 141 such that flats of the hex head engage sidewalls 164, 166 defining the retaining portion 141 so that the bolt would not rotate within the utility channel 140. This locking arrangement allows nuts or devices to be tightened onto the threads of the bolt without the bolt rotating within the utility channel.

Alternatively, a carriage bolt could be used to secure devices to the structural member 120. In such an embodiment, the head of the carriage bolt would reside in the retaining portion 141 of the utility channel 140. Flats of the carriage bolt would extend through the mouth portion 142 of the utility channel 140 and engage the sidewalls 168, 170 of the structural member 120 defining the mouth portion 142 to prevent rotation of the carriage bolt.

By including the utility channel 140, devices can be easily mounted to the structural members 120 and can also be easily positioned along the length of the structural member 120. The devices, and particularly the mounting structure, can be merely slid within the utility channel 140. This provides infinite adjustment along the length of the structural member 120.

The use of the utility channel 140 eliminates the need for aesthetically displeasing cables, tie wraps, bungee cords or other attachment devices that previously required wrapping all the way around the structural member to secure accessories to the structural members 120.

Figure 15:
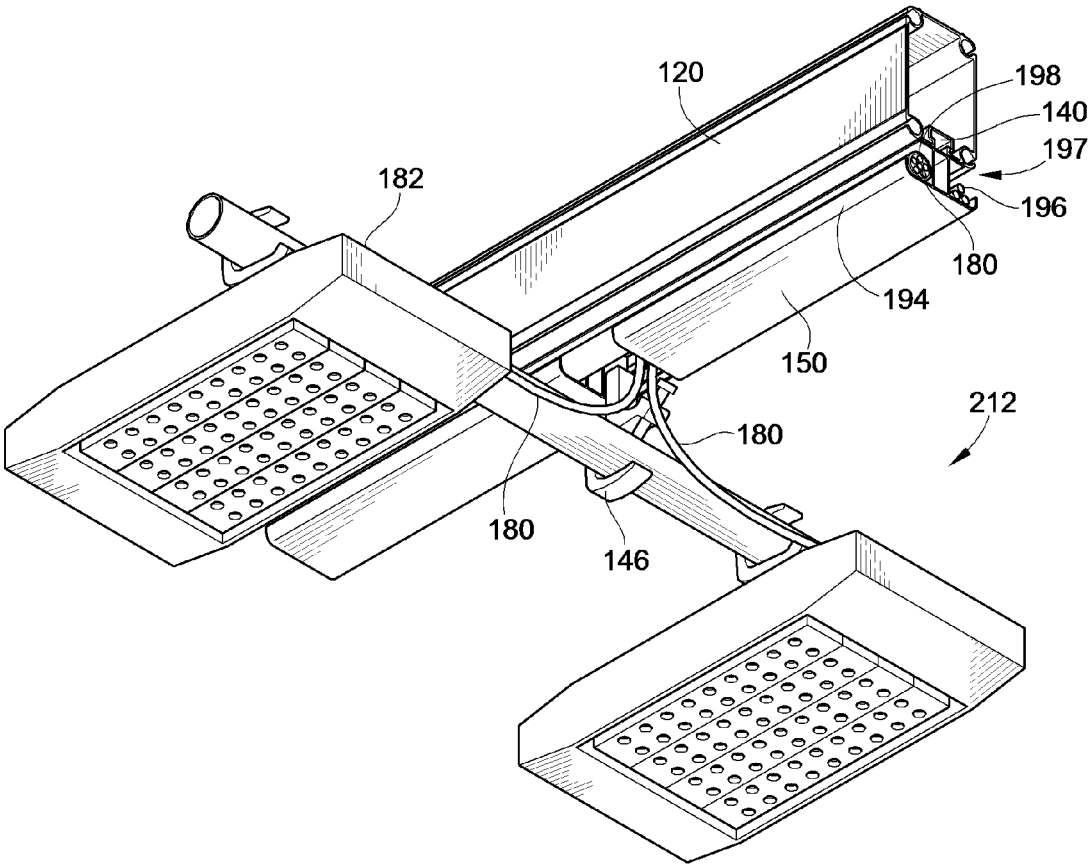
FIGS. 15 and 16 illustrate additional arrangements of devices connected to structural members utilizing a utility channel of the structural member.
Figure 16:
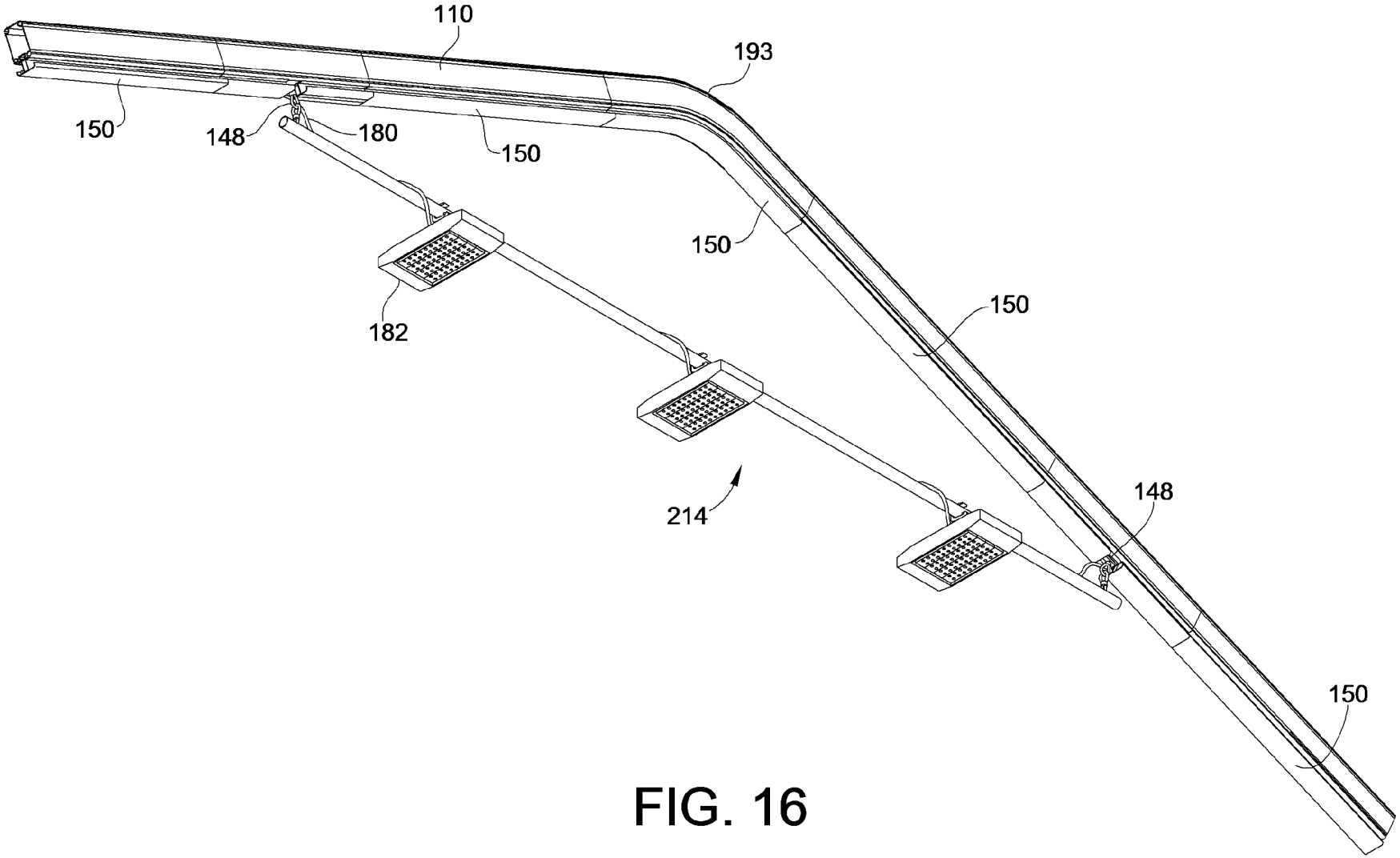

The rigid connection that can be provided between the structural members 120 and devices such as the hooks 146, carabineers 148 and wire trays 150 provides improved structural integrity and support of the accessories that are mounted to and supported by the tent frame 102, such as lights as illustrated in FIGS. 15 and 16. FIG. 16 illustrates that carabineers 148 can be used at opposite ends of a device, such as the light assembly to mount a device.

Figure 10:
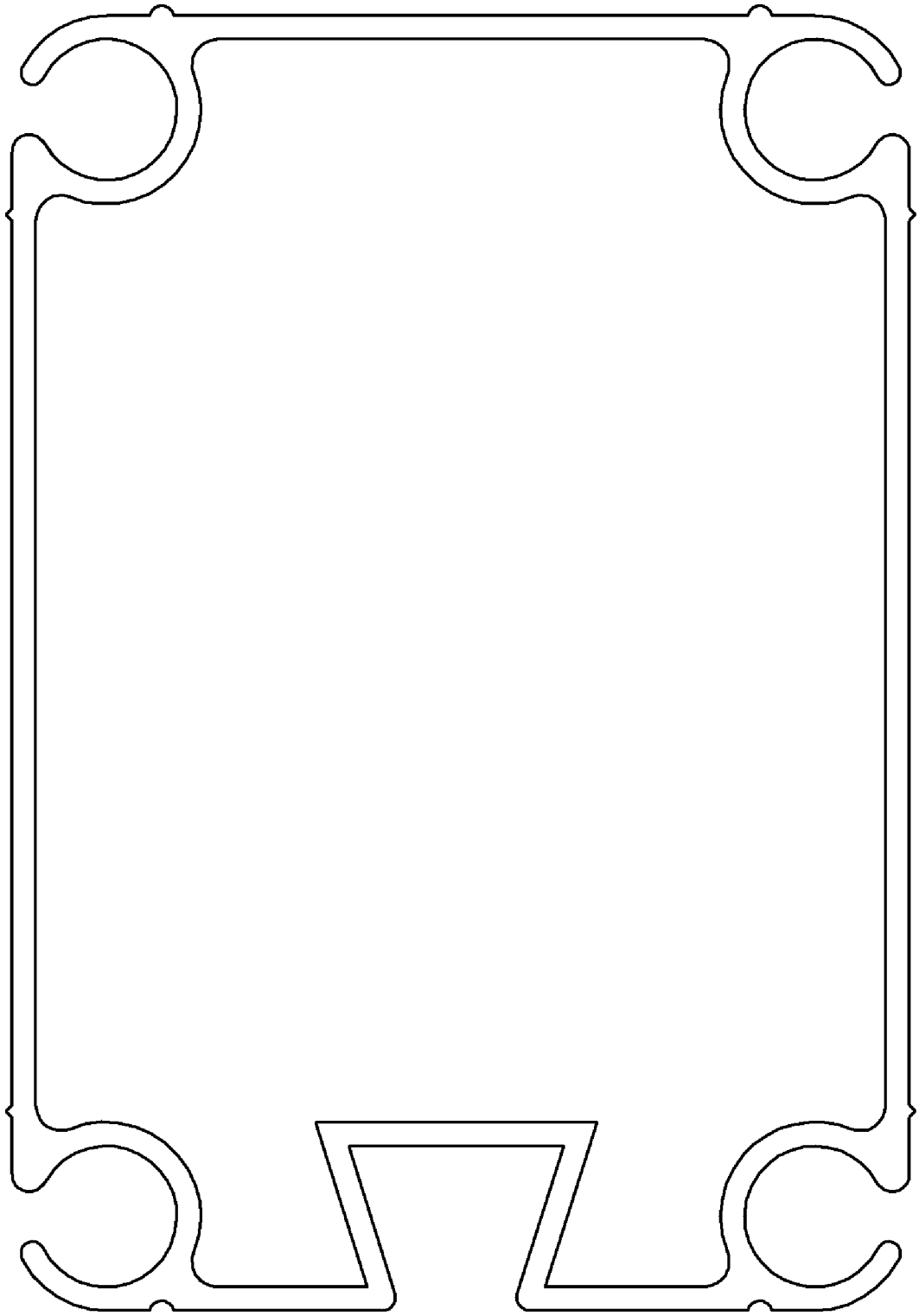
FIGS. 10 and 11 are simplified alternative cross-sections of the structural member of FIG. 2.
Figure 11:
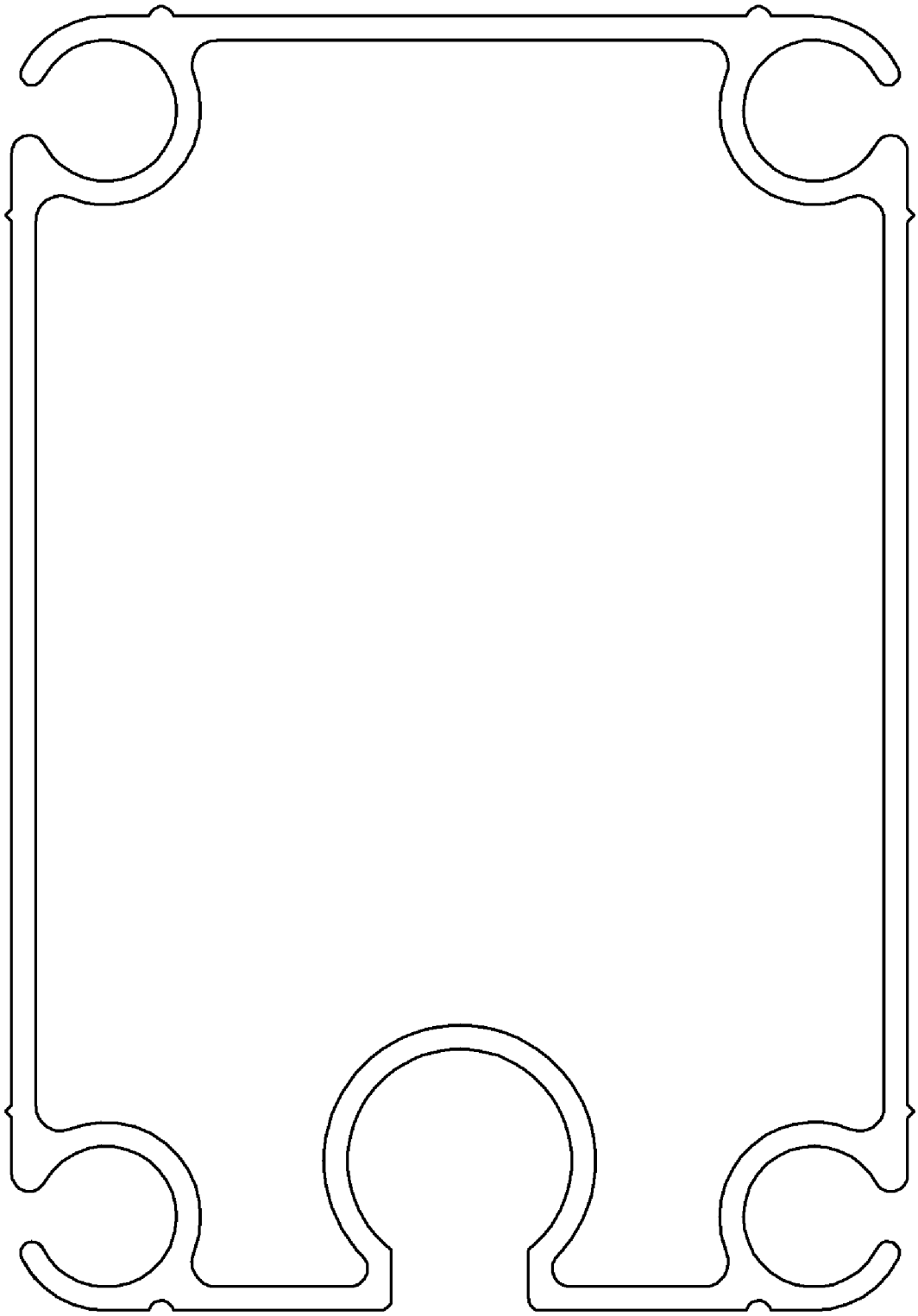

While the illustrated structural member 120 has rectangular shaped retaining and mouth portions 141, 142, alternative embodiments can have alternative shapes. For example, the retaining portion could be rounded (see FIG. 11) or trapezoidal (see FIG. 10) in cross-section.

Figure 9:
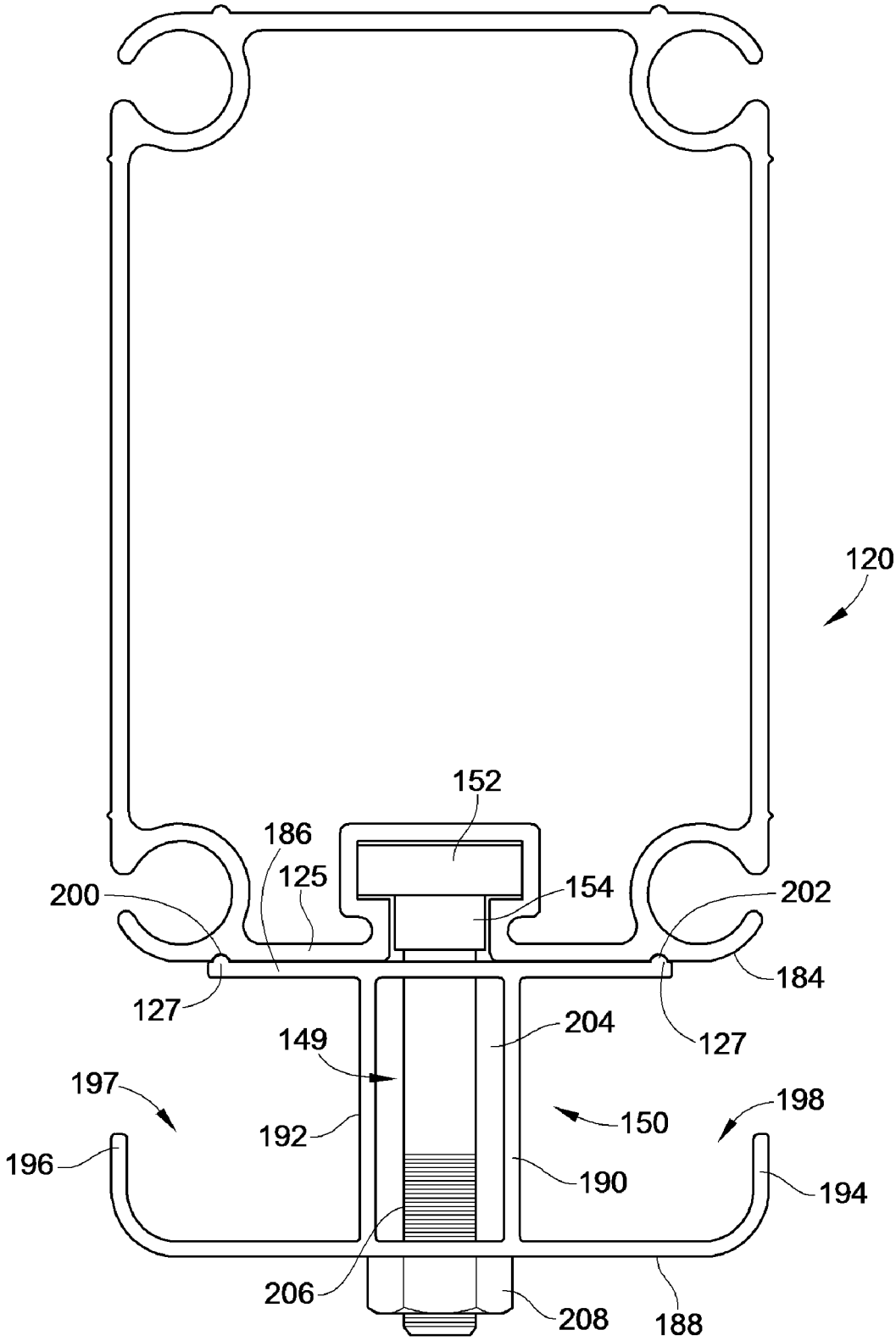

With reference to FIGS. 9, 15 and 16 wire trays 150 according to the present invention are illustrated. A wire tray 150 hides the wires 180 for the accessories such as the lights 182 as the wires 180 extend along the rafter 110 (i.e. structural member 120). For the following descriptions, rafter 110 and structural member 120 may be used interchangeably. With reference to FIG. 9, the wire tray 150 mounts to the bottom surface 184 of the support structure 120. In the illustrated embodiment, the wire tray 150 is generally T-shaped.

The wire tray 150 includes a top abutment flange 186 that abuts against the bottom surface 184 of structural member 120. A wire supporting flange 188, forming a wire holding tray portion, is offset from the abutment flange 186 by two parallel spacing walls 190, 192. The spacing walls 190, 192 extend generally perpendicular to the abutment flange 186 and the wire supporting flange 188.

The wire supporting flange 188 has upturned ends 194, 196. The wire supporting flange 188 and the spacing walls 190, 192 combine to form wire storing channels 197, 198.

The abutment flange 186 includes a pair of parallel spaced apart ribs 200, 202 running the axial length of the wire tray 150. The ribs 200, 202 insert into channels 127 formed in the bottom surface 184 of side 125. The engagement between the channels 127 and the ribs 200, 202 aligns the wire tray 150 relative to structural member 120. In the illustrated embodiment, the ribs 200, 202 are latterly spaced apart such that they straddle the spacing walls 190, 192. The ribs 200, 202 are formed proximate the lateral edges of the abutment flange 186. While the ribs 200, 202 are illustrated as being formed on the abutment flange 186 and the channels 127 are formed in the bottom surface 184 of the structural member 120, the arrangement could be switched. As such, the ribs could be formed by the structural member and the channels formed by the wire tray. If the ribs and channels were switched, the ribs 126 of the structural member would also need to be switched to channels so as to permit stacking as more fully described previously.

The wire tray 150 may be secured to the structural member 120 using an attachment member such as a T-bolt 149. The neck portion 154 of the T-bolt is long enough to extend axially through an aperture in the abutment flange 186, through a cavity 204 formed between the parallel spacing walls 190, 192 and then through an aperture formed in the wire supporting flange 188. The neck portion 154 includes a threaded end 206 that receives a nut 208 to secure the wire tray 150 to the structural member 120.

However, the wire tray could include snap structure, such as illustrated in FIG. 7 to snap-engage the wire tray 150 to the structural members 120. The snap structure could be integrally formed with the wire tray 150 or added as a separate component. For example, the snap structure could be at the end of bolt-like structure that replaces T-bolt 149. Such a device would extend through the wire tray 150 such that the snap structure would extend away from the abutment flange 186 and wire supporting flange 188.

Figure 17:
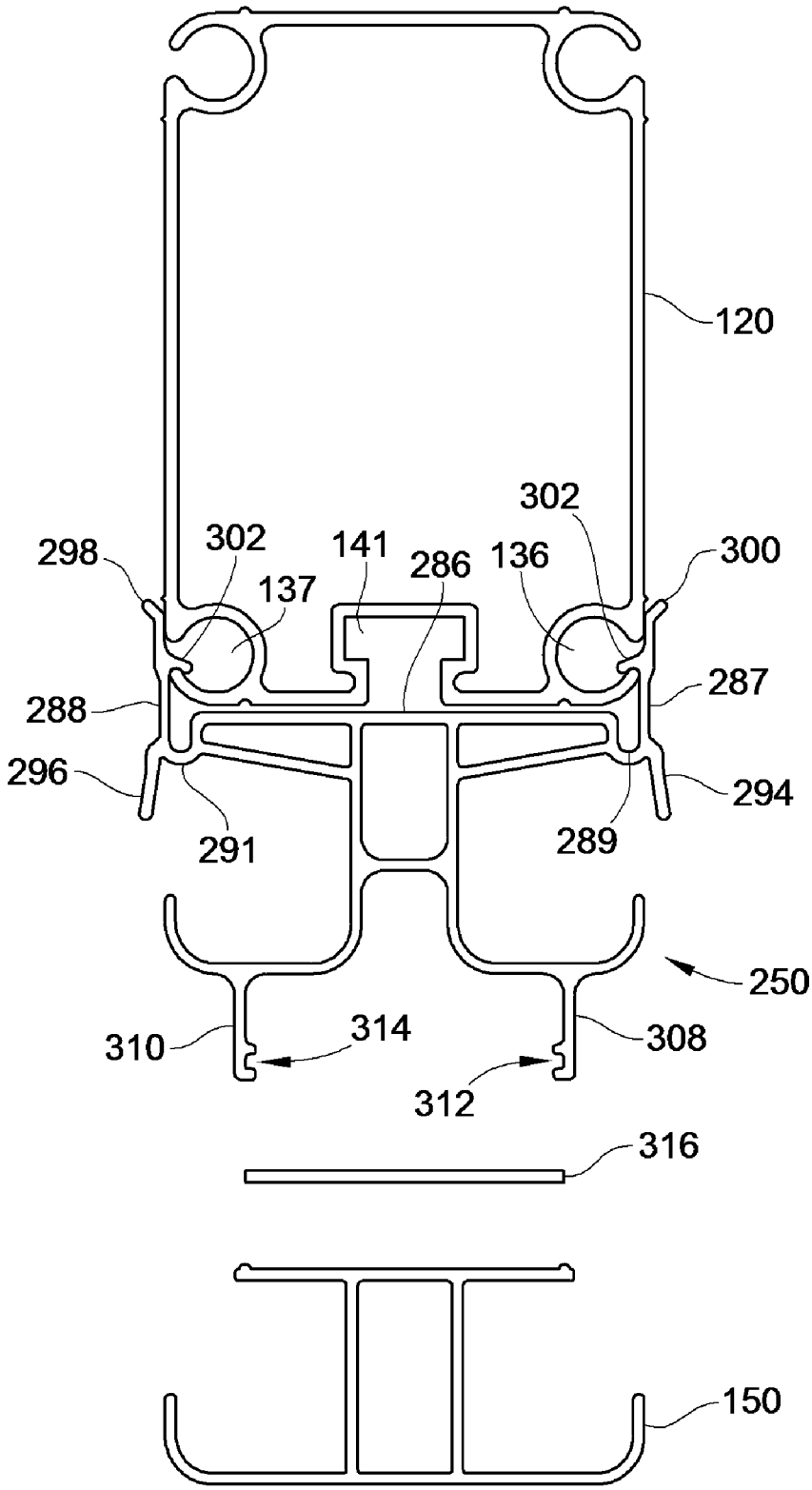
FIG. 17 is an alternative embodiment of a wire tray according to the teachings of the present invention.

A further embodiment of a wire tray 250 is illustrated in FIG. 17. This embodiment connects to the structural member 120 by engaging channels 136, 137. The wire tray 250 includes a modified abutment flange 286. The abutment flange 286 includes two clips 287, 288 on opposite ends. The clips 287, 288 are connected to the ends of the abutment flange 286 by integral hinges 289, 291. Thus, clips 287, 288 are formed as a one-piece construction with abutment flange 286. A "one-piece construction" as used herein shall not include multiple independent components connected together.

The clips 287, 288 include catch portions 302, 304 that extend laterally toward one another and through the throat of the channels 136, 137 to engage structural member 120. The clips 287, 288 also include lever portions 294, 296 spaced apart from the catch portions 302, 304. The lever portions 294, 296 permit a user to disengage the catch portions 302, 304 from the structural member 120. More particularly, the user may press lever portions 294, 296 toward one another causing the clips 287, 288 to pivot through hinges 289, 291 causing the catch portions 302, 304 to disengage channels 136, 137.

Opposite the lever portions 294, 296, the clips include flared tips 298, 300 that flare laterally outward from one another. The flared tips 298, 300 facilitate snap engaging the wire tray 250 to the structural member. They further facilitate removal of the wire tray 250 from the structural member. Further facilitating engagement between the wire tray 250 and the structural member 120, the catch portions 302, 304 have a tapered outward facing surfaces that function as cam surfaces when mounting the wire tray 250.

The wire tray also includes downward depending flanges 308, 310 that include laterally inward facing channels 312, 314 that permit additional devices to be snap engaged to wire tray 250. For example, lights 316, the attachment structure illustrated schematically as a rectangular box in FIG. 17, could be engaged between flanges 308, 310 and within channels 312, 314. Alternatively, the lights 316 could be replaced by a flat piece of material that is mounted in between flanges 308, 310. This forms an additional fully enclosed cavity to the wire tray 250 for storing additional wires. In an alternative example, another wire tray 150 (of a previous embodiment) may be snap engaged to wire tray 250 to provide for more wire support. Again, the channels 312, 314 could be replaced by a single rib that would engage channels of a connected device, such as the light or an additional wire tray.

While clips 287, 288 engage channels 136, 137 alternative embodiments could use similar clip devices that engage into utility channel 140.

A tent 100 according to the present invention may include a plurality of wire trays 150. As illustrated in FIGS. 15 and 16, a plurality of wire trays 150 may be mounted to a single rafter 110 (i.e. structural member 120). Where two wire trays 150 axially meet, an attachment device such as a carabineer 148 or clamp 146 may be interposed between the two adjacent wire trays 150 to provide a mounting location for accessories such as the light assemblies 212, 214. Further, the gap between the adjacent wire trays 150 provides an easy outlet from the wire channels 197, 198 for the wires 180 to exit the wire tray 150 and extend to the accessory, i.e. lights 182.

To secure a wire 180, the user merely inserts the wire through the gap formed between the upturned edges 194, 196 and the abutment flange 186. With the addition of the wire trays 150, there is no need to drape the wires 180 over the structural members 120 or to affix wires 180 to the structural members 120 such as by way of cords, bungee straps, wire ties, etc. Further, the wires 180 need not be fed between various structural members and the shell of the tent. Thus, the aesthetic displeasing arrangements of the free hanging wires can be substantially eliminated. The wire trays 150 can, depending on the size of the wires 180, entirely hide the wires 180 as they run along the structural members 120.

In preferred embodiments, the wire trays are formed of plastic or aluminum. However, the wire tray 150 could be formed of any suitable material such as wood, metal, etc.

Further, with reference to FIGS. 16, any bracing, fittings or connectors between various structural members may also be configured to receive a wire tray. For example, a peak fitting 193 may includes a utility channel to which a wire tray 150 may be connected. Further, the fitting 193 includes the C-shaped channels, such as channel 137 which can be further used to mount a wire tray. In other words, the bracing, fittings or connectors can be configured to continue the mounting structure of the structural members 120. The utility channel 140 of the rafters merge smoothly into the utility channel 140 of the peak fitting 193. The same arrangement occurs for channels 136, 137.

With regard to the structure of FIG. 16, wire tray 150 is arcuate in shape such that it matches the arcuate shape of the peak fitting 193. Alternatively, two separate wire trays could be positioned such that there ends stop at the beginning of the curvature of fitting 193. However, in this configuration, a portion of the wires that pass between the two wire trays would be exposed, presenting a less than ideal configuration, but a configuration none-the-less in the event that a curved wire tray is not available.

This promotes improving the aesthetic appearance of the tent by hiding the wires substantially the entire way from the ground to the device that requires the wiring. In some embodiments, wire trays may extend substantially from the foot 116 of one leg 108 across the tent to the foot 16 of a coordinated leg 108.

With reference to FIGS. 1 and 16, the wire trays would first extend up the first leg 108 from foot 116. Then the wire trays would extend along a first rafter 110 directly connected to the leg 108. Then the wire trays would extend from the first rafter 110 to a second rafter 110 connected to the first rafter by a peak fitting 193 (see FIG. 16). Next, the wire trays would extend down the second rafter 110 to a second leg 108. Finally, the wire trays would extend down along the second leg 108 connected to the second rafter 110 to the foot 116 of this second leg. Again, if any bracing or structural member connectors are positioned between two adjacent structural members, for example a leg 108 and an adjacent rafter 110, that bracing or connector may also be connected to a wire tray so that there are substantially no or very limited breaks in the wire tray from the foot 116 of one leg 108 to the foot 116 of the other leg 108, positioned across the tent.

Figure 18:
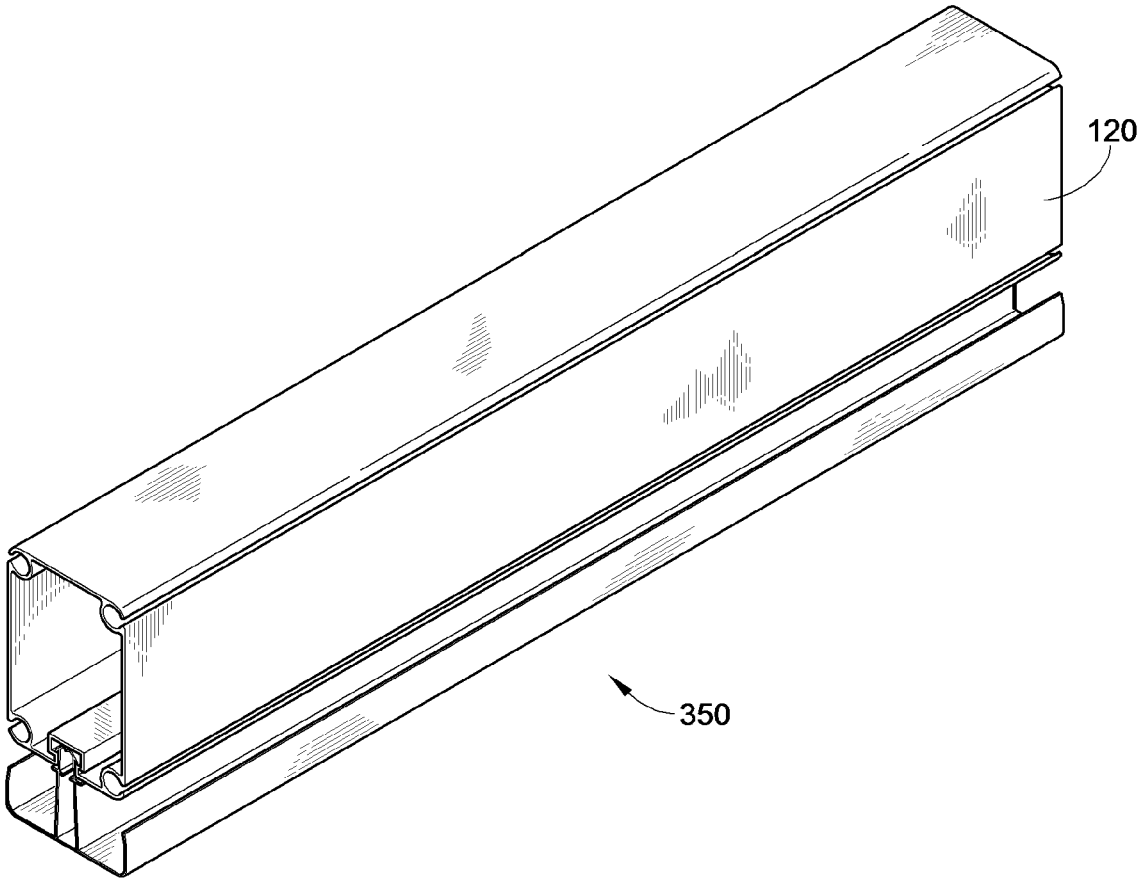
FIG. 18 is an alternative embodiment of a wire tray according to the teachings of the present invention attached to a structural member.
Figure 19:
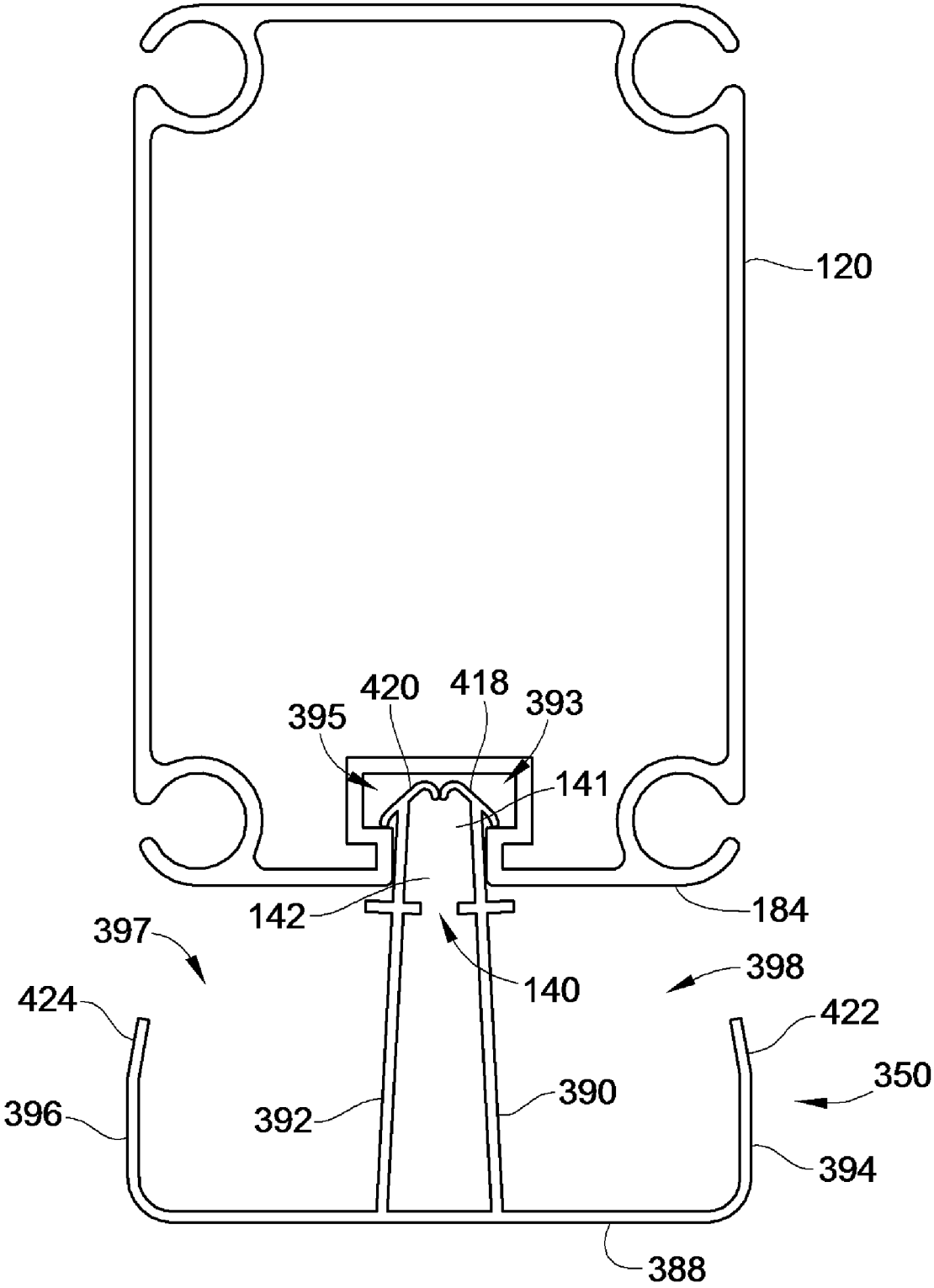
FIG. 19 is an end view illustration of the wire tray and structural member illustrated in FIG. 18.
Figure 20:
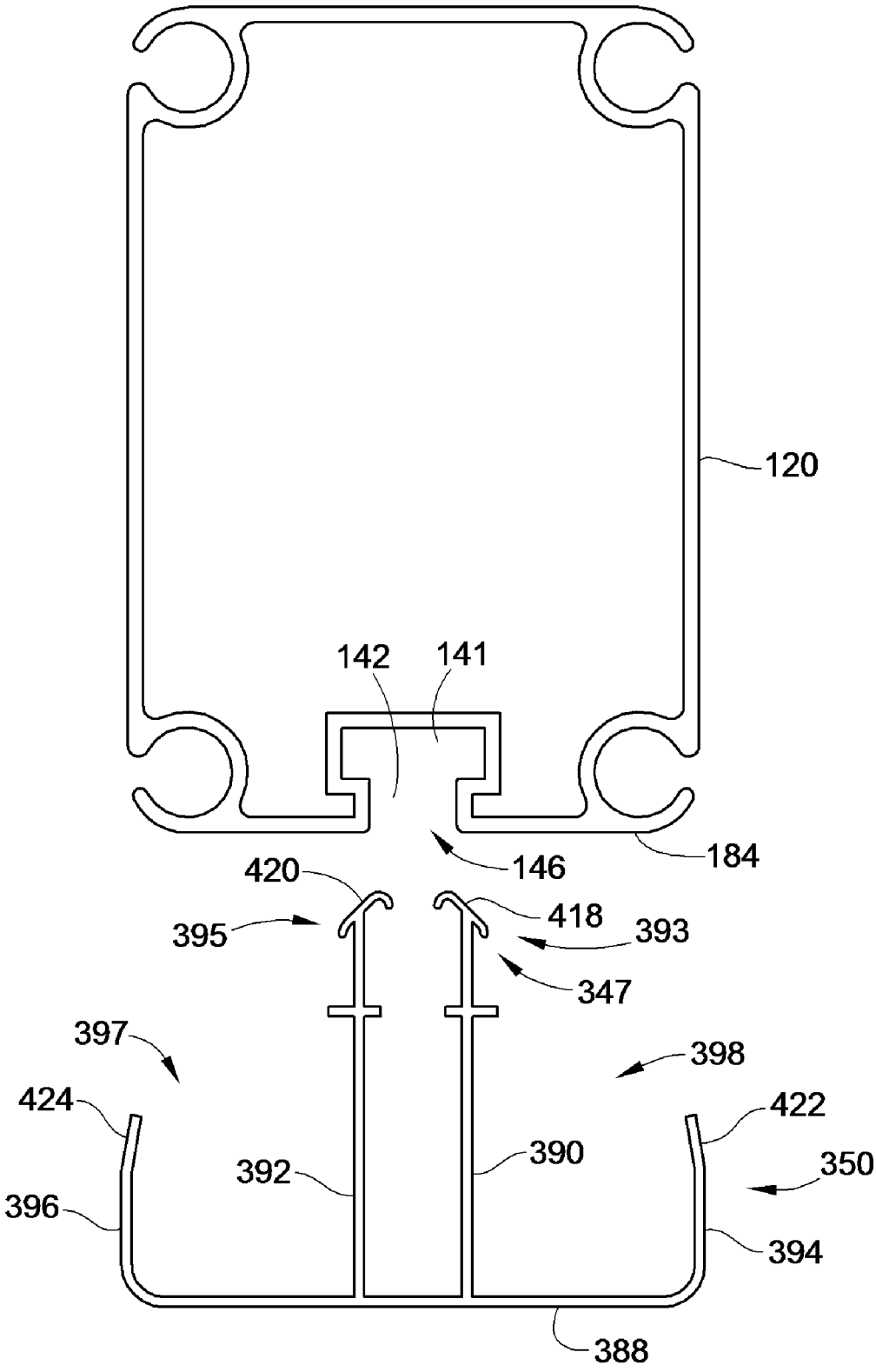
FIG. 20 is an end exploded illustration of the wire tray and structural member of FIG. 19.
Figure 21:
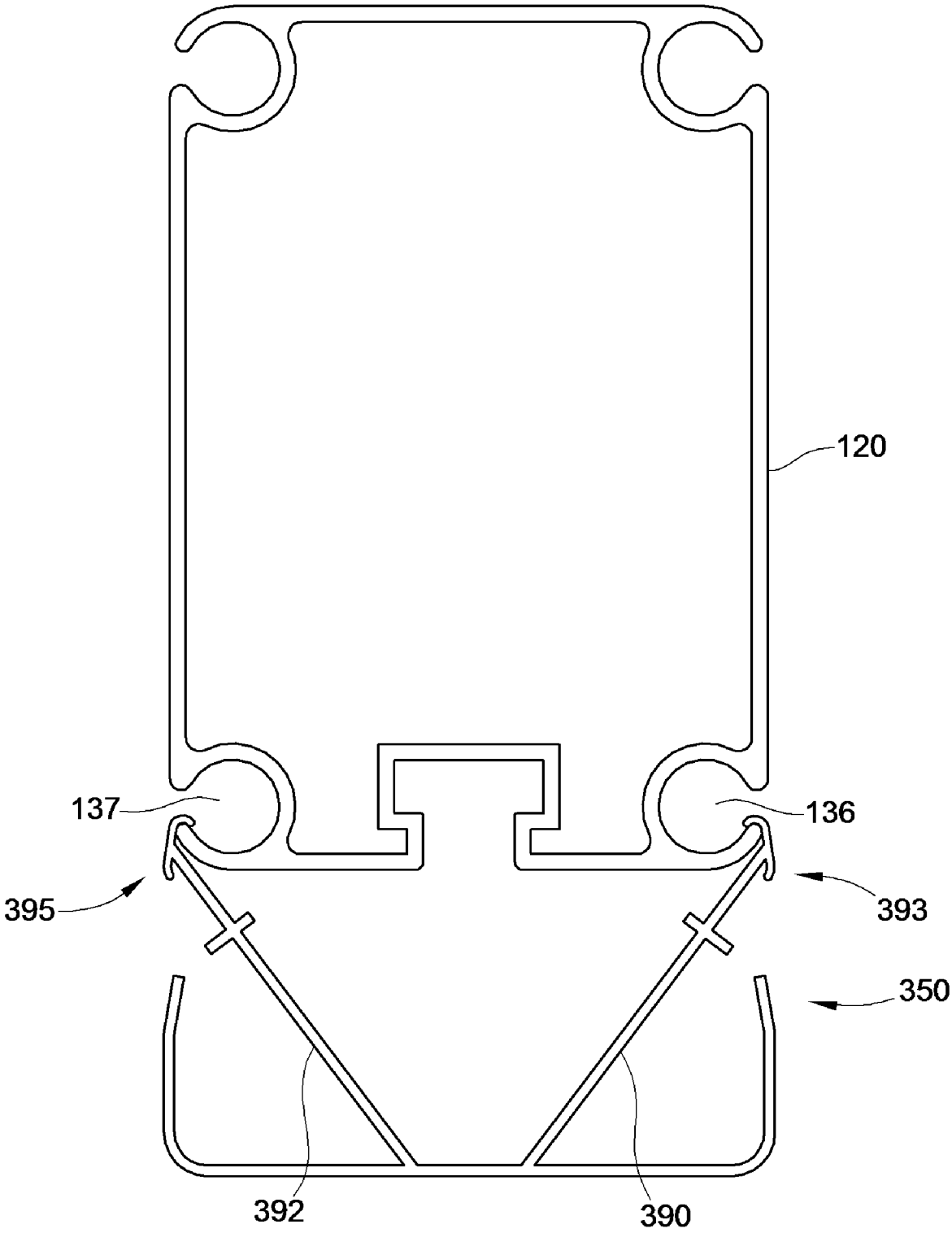
FIG. 21 is an end view illustration of the wire tray and structural member of FIG. 18, with the wire tray attached in a different manner.

FIGS. 18-22 illustrate a further embodiment of a wire tray 350. As illustrated in FIGS. 18 and 21, the wire tray is configured to be connected to different style structural members 120, 120' as well as may be connected to either a utility channel 140 (FIG. 19) or C-shaped channels 136, 137 (FIG. 21) as will be more fully described below.

FIGS. 19 and 20 illustrate end views of the wire tray 350 and a structural member 120. The wire tray 350 includes a wire supporting flange 388, forming a wire holding tray portion from which two parallel mounting walls 390, 392 extend. The mounting walls 390, 392 extend generally perpendicular to the wire supporting flange 388 when in a relaxed state. However, in other embodiments, the parallel mounting walls 390, 392 need not be parallel or could have an arcuate profile in the relaxed or bent state.

In the illustrated embodiment, the mounting walls 390, 392 are connected at a first end to the wire supporting flange 388. Preferably, the outer surfaces of the mounting walls 390, 392 are laterally spaced a greater distance than the width W2 (see FIG. 3) of the mouth portion 142 of the utility channel 140. This arrangement causes the mounting walls 390, 392 to be compressed toward one another when the wire tray 350 is mounted to the structural member 120. As such, the mounting walls 390, 392 will be canted toward one another. This provides a more secure connection between the wire tray 350 and structural member 120 by providing a loading of the sidewalls 168, 170 (see FIG. 3) forming mouth portion 142.

However, the inner surfaces of the mounting walls 390, 392 is preferably narrower than the overall width of the distance W5 (see FIG. 22) of the distance between the distal ends of the walls defining C-shaped channels 136, 137 so as to cause the mounting walls 390, 392 to compress against the distal ends when mounted to C-shaped channels 136, 137, such as illustrated in FIG. 21.

Figure 22:
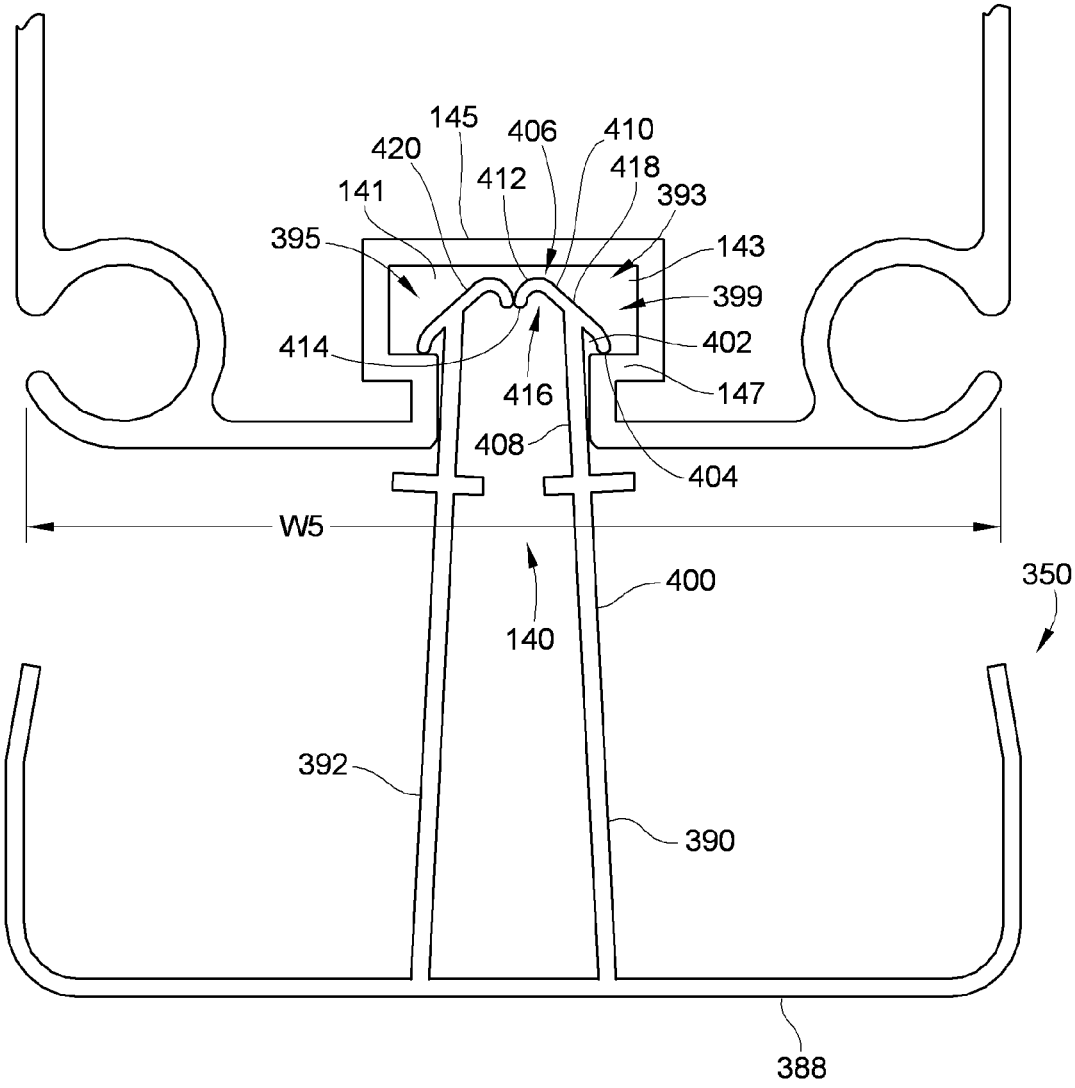
FIG. 22 is an enlarged partial end view illustration of the wire tray and structural member of FIG. 18.

Mounting clips 393, 395 are formed at the distal ends of the mounting walls 390, 392, respectively. The mounting clips 393, 395 engage the structural member 120 to secure the wire tray 350 to the structural member 120. With reference to FIG. 22 the mounting clips 393, 395 will be explained. However, only mounting clip 393 will be described as mounting clip 395 is an exact mirror opposite of mounting clip 393.

Mounting clip 393 includes an outer clip portion 399 that extends laterally outward beyond the outer surface 400 of the mounting wall 390. The outer clip portion 399 is illustrated as being canted back towards wire supporting flange 388 such that a channel 402 is formed between the outer clip portion 399 and outer surface 400. The outer clip portion 399 is canted relative to mounting wall 390 at an acute angle, but could extend at other angles, including perpendicular or obtuse, depending on the required engagement needed between the wire tray 350 and the structural member 120. The outer clip portion 399 extends laterally into undercut 143 of the retaining portion 141 of the utility channel. A distal end 404 of outer clip portion 399 axially engages bottom wall portion 147 forming a catch relationship therebetween that prevents, without other manipulation, the mounting wall 390 and mounting clip 393 from being pulled out of the utility channel 140. Preferably, the outer clip portion 399 is arcuate such that it curves back toward the mounting wall 390 so as to place the outer clip portion 399 closer to a state of compression rather than bending to increase the strength of the mounting clip 399.

Opposite the outer clip portion 399 is an inner clip portion 406. With additional reference to FIG. 21, the inner clip portion 406 is configured to engage C-shaped channels 136, 137 of a structural member 120. This provides an engagement like that of the embodiment of FIG. 17.

Returning to FIGS. 21 and 22, the inner clip portion 406 extends generally laterally inward beyond an inner surface 408 of mounting wall 390. The inner clip portion 406 is generally hook shaped and in an extension portion 410 extends outward from the mounting wall 390 at an obtuse angle and away from the wire supporting flange 388 but then includes an arcuate hook portion 412 that curves back around toward wire supporting flange 388 having a distal end 414 that generally faces wire supporting flange 388. This hook shape defines a cavity or channel 416 that receives a distal end of the wall of the structural member 120 defining the C-shaped channels 136, 137.

In one embodiment, the width W2 of the mouth portion 142 of the utility channel 140, the spacing of the outer surfaces of the mounting walls 390, 392 and the inner clip portions 406 of each mounting clip 393, 395 are configured such that when the wire tray 350 is mounted to the structural member 120, the hook portions 412 of the inner clip portions 406 laterally contact one another. In one more preferable arrangement, this contacting causes the distal ends of the mounting walls 390, 392 to be laterally biased away from one another, i.e. opposite the way they are biased by being mounted within mouth portion 142 of the utility channel 140. This arrangement further promotes securement within utility channel 140. However, other embodiments will have the arrangement of the mounting walls 390, 392, inner clip portions 406 such that the inner clip portions 406 will not contact when passing through the mouth portion 142 so as to facilitate easier installation and removal of the wire tray 350.

The top surfaces 418, 420 of the mounting clips 393, 395 face away from one another and form cam surfaces for assisting in mounting the wire tray 350 to the utility channel 140. Similarly, the outer surface of the hook portions 412 will function as cam surfaces during mounting of the wire tray 350 such as illustrated in FIG. 21.

The mounting walls 390, 392 are preferably resilient members such that the mounting walls 390, 392 can be resilient bent toward one another to disconnect the wire tray 350 and particularly outer clip portions 399 from a structural member 120 when mounted to the utility channel 140 thereof. Further, the mounting walls 390, 392 are preferably resilient such that the mounting walls 390, 392 can be resilient bent away from one another to disconnect the wire tray 350 and particularly inner clip portions 406 from a structural member 120 when mounted to the C-shaped channels 136, 137 thereof.

To assist in the resilient flexure toward one another, there is gap formed between the mounting walls 390, 392.

With reference to FIG. 19, the wire supporting flange 388 has upturned ends 394, 396. The wire supporting flange 388 and the mounting walls 390, 392 combine to form wire storing channels 397, 398. This embodiment also illustrates that the upturned ends 394, 396 also include increasingly canted end portions 422, 424 that extend inward toward each other. This provides slight undercut arrangements to assist in securing wires within the wire storing channels 397, 398.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A wire tray for mounting to a tent frame structural member comprising:

an elongated tray portion;

a first resilient mounting wall extending outward from the elongated tray portion;

a second resilient mounting wall spaced apart from the first resilient mounting wall and extending outward from the elongated tray portion:

a first mounting clip having a first clip portion extending laterally from the first resilient mounting wall; and a second mounting clip having a second clip portion extending laterally from the second resilient mounting wall, the second clip portion extending laterally opposite the first clip portion;

wherein the elongated tray portion extends laterally between first and second end portions the first and second resilient mounting walls are connected to the elongated tray portion laterally between the first and second end portions such that the first end portion is spaced laterally outward from a position where the first resilient mounting wall connects to the elongated tray portion and the second end portion is spaced laterally outward from a position where the second resilient mounting wall connects to the elongated tray portion;

a first limiting flange extending laterally outward from the first resilient mounting wall and away from the second resilient mounting wall the first limiting flange being spaced from the first mounting clip; and a second limiting flange extending laterally outward from the second resilient mounting wall and away from the first resilient mounting wall the second limiting flange being spaced from the second mounting clip.

2. The wire tray of claim 1, wherein the first and second clip portions extend away from one another and the first clip portion extends away from the second resilient mounting wall and the second clip portion extends away from the first resilient mounting wall.

3. The wire tray of claim 2, wherein:

the first mounting clip includes a third clip portion extending laterally from the first resilient mounting wall, the third clip portion extending generally opposite to the first clip portion such that the first and third clip portions extend beyond opposite sides of the first resilient mounting wall; and the second mounting clip includes a fourth clip portion extending laterally from the second resilient mounting wall, the fourth clip portion extending generally opposite to the second clip portion such that the second and fourth clip portions extend beyond opposite sides of the second resilient mounting wall.

4. The wire tray of claim 2, wherein the first and second clip portions are formed at distal ends of the first and second resilient mounting walls, respectively, the distal ends being opposite ends of the first and second resilient mounting walls connected to the elongated tray portion.

5. The wire tray of claim 4, wherein the first and second clip portions extend at an angle relative to the first and second resilient mounting walls such that the first and second clip portions extend toward the elongated tray portion forming a first cavity between the first clip portion and an outer surface of the first resilient mounting wall and a second cavity between the second clip portion and an outer surface of the second resilient mounting wall.

6. The wire tray of claim 5, wherein:

the first and third clip portions merge into one another forming a first continuous outer cam surface that is canted relative to the first resilient mounting wall and generally faces away from the second resilient mounting wall;

the second and fourth clip portions merge into one another forming a second continuous outer cam surface that is canted relative to the second resilient mounting wall and generally faces away from the first resilient mounting wall.

7. The wire tray of claim 2, wherein:

the first clip portion forms a first outer cam surface that is canted relative to the first resilient mounting wall and generally faces away from the second resilient mounting wall;

the second clip portion forms a second outer cam surface that is canted relative to the second resilient mounting wall and generally faces away from the first resilient mounting wall.

8. The wire tray of claim 1, wherein a first storage channel is spaced laterally outward from the position where the first resilient mounting wall connects to the elongated tray portion and is defined between the first resilient mounting wall and the first end portion and a second storage channel is spaced laterally outward from the position where the second resilient mounting wall connects to the elongated tray portion and is defined between the second resilient mounting wall and the second end portion, the positions where the first and second resilient mounting walls connect to the elongated tray portion being laterally between the first and second storage channels.

9. A wire tray for mounting to a tent frame structural member comprising:

an elongated tray portion;

a first resilient mounting wall extending outward from the elongated tray portion;

a second resilient mounting wall spaced apart from the first resilient mounting wall and extending outward from the elongated tray portion;

a first mounting clip having a first clip portion extending laterally from the first resilient mounting wall; and a second mounting clip having a second clip portion extending laterally from the first second resilient mounting wall, the second mounting clip portion extending laterally opposite the first clip portion; wherein:

the first mounting clip includes a third clip portion extending laterally from the first resilient mounting wall, the third clip portion extending generally opposite to the first clip portion such that the first and third clip portions extend beyond opposite sides of the first resilient mounting wall;

the second mounting clip includes a fourth clip portion extending laterally from the second resilient mounting wall, the fourth clip portion extending generally opposite to the second clip portion such that the second and fourth clip portions extend beyond opposite sides of the second resilient mounting wall;

the third and fourth clip portions being hook shaped including a first portion that extends from the first and second resilient walls as well as away from the elongated tray portion; the hook shape further including a second portion that extends from the second portion toward the elongated tray portion.

10. The wire tray of claim 9, wherein the first and second end portions of the elongated tray portion are upturned end portions, the upturned end portions being on a same side of the elongated tray portion as the first and second resilient mounting walls.

11. The wire tray of claim 10, wherein at least a distal portion of each of upturned ends is canted inwards.

12. The wire tray of claim 10, wherein distal ends of the first and second resilient mounting walls are spaced outward from the from the elongated tray portion a greater distance than the length of the upturned end portions.

13. A wire tray for mounting to a tent frame structural member comprising:

an elongated tray portion;

a first resilient mounting wall extending outward from the elongated tray portion;

a second resilient mounting wall spaced apart from the first resilient mounting wall and extending outward from the elongated tray portion;

a first mounting clip having a first clip portion extending laterally from the first resilient mounting wall;

a second mounting clip having a second clip portion extending laterally from the second resilient mounting wall, the second clip portion extending laterally opposite the first clip portion;

wherein the first and second clip portions extend away from one another and the first clip portion extends away from the second resilient mounting wall and the second clip portion extends away from the first resilient mounting wall;

wherein the first and second clip portions are formed at distal ends of the first and second resilient mounting walls, respectively, the distal ends being opposite ends of the first and second resilient mounting walls connected to the elongated tray portion;

wherein:

the first clip portion has an extension portion and a distal portion, the extension portion extending at a first angle relative to the first resilient mounting wall, the distal portion extending at a second angle relative to the extension portion such that the distal portion is more closely parallel to the first resilient mounting wall; and the second clip portion has an extension portion and a distal portion, the extension portion extending at a third angle relative to the second resilient mounting wall, the distal portion extending at a fourth angle relative to the extension portion such that the distal portion is more closely parallel to the second resilient mounting wall.

14. A tent frame assembly comprising:

at least one structural member having an elongated body defining at least one attachment structure extending along a length of the structural member;

a wire tray including a mounting structure cooperating with the attachment structure to secure the wire tray to the elongated body, the wire tray further including a first retaining channel formed between an elongated tray portion of the wire tray and the elongated body of the structural member; and the first retaining channel extending the entire length of the elongated tray portion, the first retaining channel including a first lateral mouth that extends the entire length of the first retaining channel to permit access to the first retaining channel at any location along the length of the first retaining channel.

15. The tent frame assembly of claim 14, wherein the elongated body includes a utility channel formed in a side thereof and extending along the length of the structural member, the utility channel defining a mouth portion and an enlarged mounting portion having a width that is wider than the mouth portion such that the utility channel defines a pair of undercuts on opposite sides of the mouth, the utility channel forming at least part of the at least one attachment structure;

the mounting structure of the wire tray includes:

a first resilient mounting wall extending outward from the elongated tray portion;

a second resilient mounting wall spaced apart from the first resilient mounting wall and extending outward from the elongated tray portion;

a first mounting clip having a first clip portion extending laterally from the first resilient mounting wall; and a second mounting clip having a second clip portion extending laterally from the second resilient mounting wall, the second mounting clip portion extending opposite the first clip portion; and the first and second mounting clips engage the first and second undercuts with the first and second resilient mounting walls extending through the mouth portion.

16. The tent frame assembly of claim 15, wherein the mounting structure cooperates with the utility channel such that the relative position of the wire tray along the length of the structural member is infinitely adjustable.

17. The tent frame assembly of claim 15, further including an attachment device for attaching accessories, the attachment device including a second mounting head portion received in the utility channel;

the wire tray includes a pair of generally identical wire trays, the wire trays being attached to a same elongated body and being spaced apart, the attachment device being interposed between the pair of wire trays.

18. The tent frame assembly of claim 15, wherein the first and second resilient mounting walls are connected to the elongated tray portion such that the connection points therebetween are spaced a first distance that is greater than a width of the mouth portion such that the first and second resilient mounting walls are biased toward one another by the mouth portion.

19. The tent frame assembly of claim 14, wherein the elongated body is formed from metal and the wire tray is formed from plastic.

20. The tent frame assembly of claim 14, wherein the elongated body includes a first side portion that has opposed ends that face generally away from one another and form the attachment structure, the opposed ends each having a first surface that faces generally outward and away from the rest of the structural member, the ends including a second surface that is opposite the first surface and generally faces toward the rest of the structural member and away from the first surface;

the mounting structure of the wire tray includes:

a first resilient mounting wall extending outward from the elongated tray portion;

a second resilient mounting wall spaced apart from the first resilient mounting wall and extending outward from the elongated tray portion;

a first mounting clip having a first clip portion extending laterally from the first resilient mounting wall; and a second mounting clip having a second clip portion extending laterally from the second resilient mounting wall, the second mounting clip portion extending opposite the first clip portion; and the first mounting clip directly engaging one of the opposed ends and the second clip directly engaging the other one of the opposed ends such that the first side portion is positioned between the first and second resilient mounting walls.

21. The tent frame assembly of claim 20, wherein the first and second resilient mounting walls are connected to the elongated tray portion such that the connection points therebetween are spaced a first distance that is less than a second distance between the opposed ends such that the first and second resilient mounting walls are biased away from one another by the first side portion and into engagement therewith.

22. The tent frame assembly of claim 14, wherein the mounting structure of the wire tray includes:

a first resilient mounting wall extending outward from the elongated tray portion;

a second resilient mounting wall spaced apart from the first resilient mounting wall and extending outward from the elongated tray portion;

a first mounting clip having a first clip portion extending laterally from the first resilient mounting wall; and a second mounting clip having a second clip portion extending laterally from the second resilient mounting wall, the second clip portion extending laterally opposite the first clip portion; and wherein the first retaining channel is not formed between the first and second resilient mounting walls.

23. The tent frame assembly of claim 22, further comprising a second retaining channel formed between the elongated tray portion of the wire tray and the elongated body of the structural member, the second retaining channel extending the entire length of the elongated tray portion, the second retaining channel including a second lateral mouth that extends the entire length of the second retaining channel to permit access to the second retaining channel at any location along the length of the second retaining channel.

24. The tent frame assembly of claim 23, wherein the first and second resilient mounting walls are laterally interposed between the first and second retaining channels.

25. The tent frame assembly of claim 14, wherein the first retaining channel is entirely external of the at least one structural member.

26. The tent frame assembly of claim 14, wherein the first retaining channel is accessible in a direction extending perpendicular to the length of the wire tray.

* * * * *